US006670087B2

(12) United States Patent
Fujikawa et al.

(10) Patent No.: US 6,670,087 B2
(45) Date of Patent: Dec. 30, 2003

(54) TONER, IMAGE-FORMING APPARATUS, PROCESS CARTRIDGE AND IMAGE FORMING METHOD

(75) Inventors: Hiroyuki Fujikawa, Kanagawa (JP); Masaaki Taya, Shizuoka (JP); Takakuni Kobori, Shizuoka (JP); Masami Fujimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 09/985,517

(22) Filed: Nov. 5, 2001

(65) Prior Publication Data

US 2002/0098431 A1 Jul. 25, 2002

(30) Foreign Application Priority Data

Nov. 7, 2000 (JP) ..... 2000-338682

(51) Int. Cl.[7] ..... G03G 9/00

(52) U.S. Cl. ..... 430/109.2; 430/109.3; 430/111.4; 430/111.41

(58) Field of Search ..... 430/109.2, 109.3, 430/111.41, 111.4

(56) References Cited

U.S. PATENT DOCUMENTS

| | | | | |
|---|---|---|---|---|
| 2,297,691 | A | 10/1942 | Carlson | |
| 3,941,898 | A | 3/1976 | Sadamatsu et al. | 427/18 |
| 4,883,734 | A | 11/1989 | Ikeuchi et al. | 430/109 |
| 5,169,738 | A | 12/1992 | Tanikawa et al. | 430/106.6 |
| 5,262,265 | A | 11/1993 | Matsunaga et al. | 430/109 |
| 5,338,894 | A | 8/1994 | Uchiyama et al. | 118/653 |
| 5,370,958 | A | 12/1994 | Shin et al. | 430/110 |
| 5,424,810 | A | 6/1995 | Tomiyama et al. | 355/251 |
| 5,439,770 | A | 8/1995 | Taya et al. | 430/106 |
| 5,466,553 | A | 11/1995 | Okutani et al. | 430/109 |
| 5,518,848 | A | 5/1996 | Ito et al. | 430/96 |
| 5,641,600 | A | 6/1997 | Kotaki et al. | 430/106.6 |
| 5,652,620 | A | 7/1997 | Uchida et al. | 428/404 |
| 5,712,073 | A | 1/1998 | Katada et al. | 430/110 |
| 5,874,019 | A | 2/1999 | Uchida et al. | 252/62.59 |
| 5,968,701 | A | 10/1999 | Onuma et al. | 430/110 |
| 5,972,553 | A | 10/1999 | Katada et al. | 430/110 |
| 5,985,506 | A | 11/1999 | Yuasa et al. | 430/137 |
| 6,316,157 | B1 | 11/2001 | Yoshikawa et al. | 430/110 |

FOREIGN PATENT DOCUMENTS

| | | |
|---|---|---|
| GB | 2 101 757 | 1/1983 |
| JP | 42-23910 | 11/1967 |
| JP | 43-24748 | 10/1968 |
| JP | 76-23354 | 7/1976 |
| JP | 55-90509 | 7/1980 |
| JP | 57-178249 | 11/1982 |
| JP | 57-178250 | 11/1982 |
| JP | 59-33787 | 2/1984 |
| JP | 60-4946 | 1/1985 |
| JP | 61-34070 | 2/1986 |
| JP | 61-110155 | 5/1986 |
| JP | 61-110156 | 5/1986 |
| JP | 62-9256 | 1/1987 |

(List continued on next page.)

*Primary Examiner*—Mark A. Chapman
(74) *Attorney, Agent, or Firm*—Fitzpatrick, Cella, Harper & Scinto

(57) ABSTRACT

In a toner comprising a binder resin and a colorant, the toner contains as the binder resin at least a vinyl resin selected from the group consisting of i) a vinyl resin having a carboxyl group and a vinyl resin having an epoxy group, ii) a vinyl resin having a carboxyl group and an epoxy group and iii) a vinyl resin produced by the reaction of a carboxyl group with an epoxy group, and the toner has, in its dielectric dissipation factor (tan δ), at least a maximum value and a minimum value in the temperature range of from 20° C. to 150° C., and, where the maximum value is represented by Max and the minimum value by Min, has a value of $\log_{10}(Max/Min) \leqq 2$. Also disclosed are an image-forming apparatus, a process cartridge and an image-forming method which make use of the toner.

44 Claims, 4 Drawing Sheets

FOREIGN PATENT DOCUMENTS

| | | |
|---|---|---|
| JP | 62-194260 | 8/1987 |
| JP | 62-278131 | 12/1987 |
| JP | 63-214760 | 9/1988 |
| JP | 63-217362 | 9/1988 |
| JP | 63-217363 | 9/1988 |
| JP | 63-217364 | 9/1988 |
| JP | 1-257968 | 10/1989 |
| JP | 2-168264 | 6/1990 |
| JP | 2-235069 | 9/1990 |
| JP | 3-18552 | 1/1991 |
| JP | 3-63661 | 3/1991 |
| JP | 3-63662 | 3/1991 |
| JP | 3-63663 | 3/1991 |
| JP | 4-124681 | 4/1992 |
| JP | 5-72801 | 3/1993 |
| JP | 5-173363 | 7/1993 |
| JP | 5-173366 | 7/1993 |
| JP | 5-241371 | 9/1993 |
| JP | 5-281778 | 10/1993 |
| JP | 5-345616 | 12/1993 |
| JP | 6-11890 | 1/1994 |
| JP | 6-51556 | 2/1994 |
| JP | 62-222612 | 8/1994 |
| JP | 7-20654 | 1/1995 |
| JP | 7-110598 | 4/1995 |
| JP | 7-175262 | 7/1995 |
| JP | 7-225491 | 8/1995 |
| JP | 8-25747 | 1/1996 |
| JP | 8-44107 | 2/1996 |
| JP | 8-101529 | 4/1996 |
| JP | 9-59024 | 3/1997 |
| JP | 9-59025 | 3/1997 |
| JP | 9-185182 | 7/1997 |
| JP | 9-244295 | 9/1997 |
| JP | 9-319410 | 12/1997 |
| JP | 10-87837 | 4/1998 |
| JP | 10-90943 | 4/1998 |

MEASURING CHART OF DIELECTRIC DISSIPATION FACTOR IN EXAMPLE 1

TONER, IMAGE-FORMING APPARATUS, PROCESS CARTRIDGE AND IMAGE FORMING METHOD

BACKGROUND OF THE INVENTION

1. Field of the Invention

This invention relates to a toner used in recording processes such as electrophotography, electrostatic recording, magnetic recording and toner jet recording, and an image-forming apparatus, a process cartridge and an image-forming method which make use of the toner; the image-forming method being a method of forming a fixed image by heat and pressure fixing a toner image formed on a transfer medium.

2. Related Background Art

A number of methods as disclosed in U.S. Pat. No. 2,297,691, Japanese Patent Publications No. 42-23910 and No. 43-24748 and so forth are conventionally known as methods for electrophotography. In general, copies are obtained by forming an electric latent image (electrostatic latent image) on a photosensitive member by various means utilizing a photoconductive material, subsequently developing the latent image by the use of a toner to form a toner image, and transferring the toner image to a transfer medium (recording medium) such as paper as occasion calls, followed by fixing by the action of heat, pressure, heat-and-pressure, or solvent vapor. The toner that has not transferred and has remained on the photosensitive member is cleaned by various means, and then the above process is repeated.

In recent years, as a reflection of changing commercial needs for making composite, personal and so forth, such copying machines are severely sought to be made more small-sized, more light-weight, more high-speed and more highly reliable. As the result, performances required for toners have also become high-level.

In particular, one-component development making use of magnetic toners is preferably used because of its developing assembly having a simple structure, which may cause less troubles, has a long lifetime and may require only easy maintenance service.

Still in recent years, image-forming apparatus employing an electrophotographic technique, such as copying machines and laser beam printers, have been made to have various functions, and toner images to be formed are sought to be of high precision and high image quality. Accordingly, used are toners suited therefor and process cartridges making use of such toners.

For example, Japanese Patent Publication No. 51-23354 discloses a toner comprising a vinyl polymer cross-linked to an appropriate degree by adding a cross-linking agent and a molecular weight modifier. Also proposed in a large number are toners of a blend type comprising a vinyl polymer in which its Tg, molecular weight and gel content are specified in combination.

Such toners containing a cross-linked vinyl polymer or a gel content have an excellent effect on anti-offset properties. However, where such a cross-linked vinyl polymer is used in order to incorporate it in a toner, the polymer may have a very great internal friction in the step of melt kneading when the toner is produced, and a large shear force is applied to the polymer. Hence, in many cases, the cutting of molecular chains occurs to cause a decrease in melt viscosity, and this may adversely affect the anti-offset properties.

Accordingly, to solve this problem, it is proposed, as disclosed in Japanese Patent Applications Laid-open No. 55-90509, No. 57-178249, No., 57-178250 and No. 60-4946, that, a resin having a carboxylic acid and a metal compound are used as toner materials and are heated and reacted at the time of melt kneading to form a cross-linked polymer, which is then incorporated into the toner.

Japanese Patent Applications Laid-open No. 61-110155 and No. 61-110156 also disclose that a binder having as essential constituent units a vinyl resin monomer and also a special monoester compound is allowed to react with a polyvalent metal compound to carry out cross-linking through a metal.

Japanese Patent Applications Laid-open No. 63-214760, No. 63-217362, No. 63-217363 and No. 63-217364 still also disclose that a binder resin has a molecular weight distribution separated into two groups, a low-molecular weight region and a high-molecular weight region, and carboxylic acid groups incorporated into the low-molecular weight region side are allowed to react with polyvalent metal ions to carry out cross-linking (a dispersion of a metal compound is added in a solution obtained by solution polymerization, followed by heating to carry out the reaction).

Japanese Patent Applications Laid-open No. 2-168264, No. 2-235069, No. 5-173363, No. 5-173366 and No. 5-241371 still also disclose toner binder compositions and toners in which the molecular weights, mixing ratio, acid values and their percentages of a low-molecular weight component and a high-molecular weight component in a binder resin are controlled to improve fixing performance and anti-offset properties.

Japanese Patent Application Laid-open No. 62-9256 still also discloses a toner binder composition comprising a blend of two kinds of vinyl resins having different molecular weights and acid values of resin.

Japanese Patent Applications Laid-open No. 3-63661, No. 3-63662, No. 3-63663 and No. 3-18552 still also disclose that a carboxyl-group-containing vinyl copolymer and an epoxy-group-containing vinyl copolymer are allowed to react with a metal compound to carry out cross-linking.

Japanese Patent Applications Laid-open No. 7-225491 and No. 8-44107 still also disclose that a carboxyl-group-containing resin reacts with an epoxy resin to form a cross-linked structure.

Japanese Patent Applications Laid-open No. 62-194260, No. 6-11890, No. 6-222612, No. 7-20654, No. 9-185182, No. 9-244295, No. 9-319410, No. 10-87837 and No. 10-90943 still also disclose toner binder compositions and toners in which molecular weight distribution, gel content, acid value and epoxy value are controlled in a resin composition constituted of a carboxyl-group-containing resin, using a glycidyl-group-containing resin as a cross-linking agent, to improve fixing performance and anti-offset properties.

These proposals disclosed as shown above, though having merits and demerits, have in fact attained good effects with respect to the improvement in anti-offset properties. There, however, are problems in developing performance and running performance when applied to magnetic toners for one-component development. Thus, a further improvement is required.

Japanese Patent Applications Laid-open No. 1-257968, No. 4-124681 and No. 6-51556 also disclose magnetic toners whose dielectric dissipation factor has been controlled to provide toners having good chargeability.

In the above proposal, however, there is a problem when applied in high-speed machines having a large copy volume, and a further improvement is required in order to improve the dispersibility of resins and magnetic materials.

As stated in the above proposals, the quality of image formation depends greatly on charging performance of magnetic toners. In the magnetic toners, a magnetic material is incorporated into a toner to endow the toner with magnetic properties. Also, part of the magnetic material stands liberated from toner particles or uncovered to their surfaces, and hence it influences the fluidity of magnetic toner and the triboelectric chargeability with a charging member in a developing assembly to influence developing performance and running performance. In particular, in recent years, a high running performance is required as a performance of the magnetic toner, and hence it is difficult to achieve both the properties of a resin and the dispersibility of a magnetic material which are used in toner particles. Especially when a cross-linked type resin is used, a further improvement is required for resin materials and magnetic materials.

Many proposals have been made on the magnetic materials. For example, a magnetic material incorporated with silicon and zinc is proposed in Japanese Patent Application Laid-open No. 8-101529; magnetic materials incorporated with silicon are proposed in Japanese Patent Applications Laid-open No. 7-175262, No. 5-72801, No. 62-278131, No. 61-34070, No. 8-25747, No. 9-59024 and No. 9-59025; magnetic materials incorporated with silicon and aluminum are proposed in Japanese Patent Applications Laid-open No. 7-110598 and No. 5-281778; and a magnetic toner making use of a magnetic material incorporated with magnesium is proposed in Japanese Patent Application Laid-open No. 5-345616. Good developing performance has been attained in these proposals. However, when used in positively chargeable magnetic toners, when used in high-speed machines and when copies are taken in a very large volume over a long period of time with repetition of toner supply, it is long awaited to further improve developing performance of toners and to improve running performance, e.g., prevent the magnetic material from being liberated from toner particles.

Thus, in order to prevent the magnetic material from being liberated from toner particles, the improvement of magnetic materials alone has a limit, and the improvement of binder resins to be used is also required.

Meanwhile, various methods and apparatus have been developed with regard to the step of fixing toner images to sheets such as paper. A fixing method most common at present is a pressure heating method making use of a fixing unit which fixes toner images through a pressure roller by means of a fixing roller having a stationary heater.

In this fixing unit, the fixing roller is formed in a hollow body. On the axis of this fixing roller, a heating medium is held by a holding means. The heating medium is constituted of, e.g., a tubular heater such as a halogen lamp, and generates heat upon application of a stated voltage. Since the halogen lamp is positioned on the axis of the fixing roller, the heat generated from the halogen lamp is uniformly radiated against the inner wall of the fixing roller, so that the outer wall of the fixing roller has a temperature distribution which is uniform in the circumferential direction. The outer wall of the fixing roller is heated until its temperature reaches a temperature suited to fixing (e.g., 150 to 200° C.). In this state, the fixing roller and the pressure roller are rotated in the directions opposite to each other while coming into pressure contact, and hold between them a sheet to which a toner image has adhered. At a pressure contact zone (hereinafter also "nip") between the fixing roller and the pressure roller, the toner image on the sheet is melted by the heat of the fixing roller and is fixed to the sheet by the pressure acting from both rollers.

However, since in the above fixing unit having the heating medium constituted of a halogen lamp the fixing roller is heated by utilizing the heat radiated from the halogen lamp, it takes a relatively long time as the time by which the temperature of the fixing roller reaches the stated temperature suited to fixing after a power source has been put on (hereinafter "warm-up time"). During that time, users can not use the copying machine and are compelled to wait for a long time. There has been such a problem.

On the other hand, application of electric power to the fixing roller in a large quantity in order to improve user's operability in an attempt to shorten the warm-up time results in an increase in power consumption in the fixing unit, bringing about a problem that this goes against energy saving. Accordingly, in order to make copying machines and so forth have a higher commercial value, it has more attracted notice and been considered important to achieve both the energy saving of the fixing unit (i.e., low power consumption) and the improvement in user's operability (i.e., quick printing).

As a unit that meets such a demand, a fixing unit of an induction heating type which utilizes high-frequency induction as a heating source is proposed as disclosed in Japanese Patent Application Laid-open No. 59-33787. This induction heating fixing unit comprises a hollow fixing roller made of a metallic conductor, in the interior of which a coil is provided in a concentric form. To this coil, a high-frequency electric current is flowed to form a high-frequency magnetic field, through which the fixing roller is caused to generate an induction eddy current so that the fixing roller itself can be brought into generation of Joule heat on account of the skin resistance of the fixing roller itself. This fixing unit of an induction heating type makes it possible to shorten the warm-up time because of a great improvement in electricity-heat conversion efficiency.

A core (magnetic-field barrier member) comprised of a magnetic material may also be used in the coil in combination, whereby the high-frequency magnetic field can efficiently be formed. Especially when a core having a T-shaped cross section is used, the heat in an amount necessary as the fixing unit can be generated by a low electric power on account of the efficient convergence of the high-frequency magnetic field and the effect of shielding the part other than the heat-generating portion from the magnetic field.

However, in the conventional case as stated above, there has been a problem as stated below. In the above fixing unit of an induction heating type, in order to make the most of a strong point that the time taken until the surface temperature of the fixing roller reaches the temperature suited to fixing can be shortened when the fixing unit has started operating, it is better for the fixing roller to have a heat capacity as small as possible. Use of a fixing roller having a small wall thickness for that purpose makes it difficult to set high the pressing force at the fixing nip because of a rigidity of the fixing member, making it difficult to set low the fixing temperature. Also, in this case, the heat is transmitted with difficulty in the direction of the rotating shaft of the fixing roller. For example, when small-sized sheets of paper are continuously fed to pass, the fixing roller tends to have a large difference in temperature between the paper pass area and the paper non-pass area. Here, any temperature control made at the paper pass area of the fixing roller may make the paper non-pass area have a greatly higher temperature than the temperature suited to fixing, to tend to cause the offset of toner to the fixing roller surface at the paper non-pass area or cause paper jam because of the winding of paper around the fixing roller.

The high-frequency magnetic field formed by flowing the high-frequency electric current to the coil may also slightly leak from the magnetic-field barrier member to tend to disorder unfixed magnetic toner images on the transfer medium before their rush into the fixing unit, to cause "spots around line images at fixing". Such a problem may be solved by increasing the transfer electric current at the time of transfer in order to make stronger the electrostatic force acting between the toner and the transfer medium. This, however, may cause a difficulty that the discharge current under a high electric field comes around to the photosensitive member to roughen the photosensitive member surface to shorten the lifetime of the photosensitive member.

In addition, in the system making use of the fixing unit of an induction heating type, part of the magnetic material liberated as stated previously tends to disorder the unfixed toner images because of the high-frequency magnetic field which leaks from the fixing unit.

As discussed above, the toners used in the one-component development method and in the fixing method of an induction heating type have become required to have higher performances than those used in other methods, and are required to be much more improved in developing performance, fixing performance and anti-offset properties.

SUMMARY OF THE INVENTION

An object of the present invention is to solve the above problems to provide a toner having superior developing performance and running performance, and an image-forming apparatus and a process cartridge which develop electrostatic latent images by the use of the toner.

Another object of the present invention is to provide a toner which has superior low-temperature fixing performance and high-temperature anti-offset properties in low-speed processing up to high-speed processing and can form sharp images without causing any spots around line images at fixing, even when toner images on a transfer medium (recording medium) are heat-fixed by an electromagnetic induction heating method to form fixed images on the transfer medium.

Still another object of the present invention is to provide an image-forming method which can achieve both the energy saving of the fixing unit (i.e., low power consumption) and the improvement in user's operability (i.e., quick printing).

The present invention provides a toner comprising a binder resin and a colorant, wherein;

the toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and the toner has, in its dielectric dissipation factor (tan δ), at least a maximum value and a minimum value in the temperature range of from 20° C. to 150° C., and, where the maximum value is represented by Max and the minimum value by Min, has a value of $\log_{10}(Max/Min) \leqq 2$.

The present invention also provides an image-forming apparatus comprising a developing means for moving a toner to an electrostatic latent image formed on a photosensitive member, to render the electrostatic latent image visible to form a toner image, and a transfer means for transferring the toner image to a transfer medium to form an image;

in a developer-carrying member of said developing means, at least an alternating-current bias being applied to make the toner adhere to the electrostatic latent image to form a visible image; and the toner comprising a binder resin and a colorant;

wherein;

the toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and the toner has, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$.

The present invention still also provides a process cartridge which is used in an image-forming apparatus in which a toner is moved to an electrostatic latent image formed on a photosensitive member, to render the electrostatic latent image visible to form a toner image, and the toner image is transferred to a transfer medium to form an image; the process cartridge being detachably mountable to the image-forming apparatus;

the photosensitive member and at least one means selected from a charging means for charging the photosensitive member electrostatically, a latent-image-forming means for forming the electrostatic latent image on the photosensitive member, a transfer means for transferring the toner image to the transfer medium and a cleaning means for removing a toner having remained on the photosensitive member after the toner image has been transferred to the transfer medium being supported as one unit together with a developing means by which the electrostatic latent image formed on the photosensitive member is developed with the toner to form the toner image;

in a developer-carrying member of the developing means, at least an alternating-current bias being applied to make the toner adhere to the electrostatic latent image to form a visible image; and the toner comprising a binder resin and a colorant;

wherein;

the toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and the toner has, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$.

The present invention further provides an image-forming method comprising subjecting a toner image held on a transfer medium, to heat-and-pressure fixing by a heat-and-pressure fixing means to form a fixed image on the transfer medium, wherein;

(1) a toner which forms the toner image is a toner comprising a binder resin and a colorant;
the toner containing as the binder resin at least a vinyl resin selected from the group consisting of:
a vinyl resin having a carboxyl group and a vinyl resin having an epoxy group;
a vinyl resin having a carboxyl group and an epoxy group; and
a vinyl resin produced by the reaction of a carboxyl group with an epoxy group; and
the toner having, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$; and (2) as the heat-and-pressure fixing means, a heat-and-pressure fixing means is used which has at least;
(i) a magnetic field generation means;
(ii) a rotary heating member having at least a heat generation layer capable of generating heat by electromagnetic induction and a release layer; and
(iii) a rotary pressure member which forms a nip with the heating member; and the toner image held on the transfer medium is heat and pressure fixed while the rotary pressing member is pressed against the rotary heating member via the transfer medium.

DETAILED DESCRIPTION OF THE PREFERRED EMBODIMENTS

Figure 1:
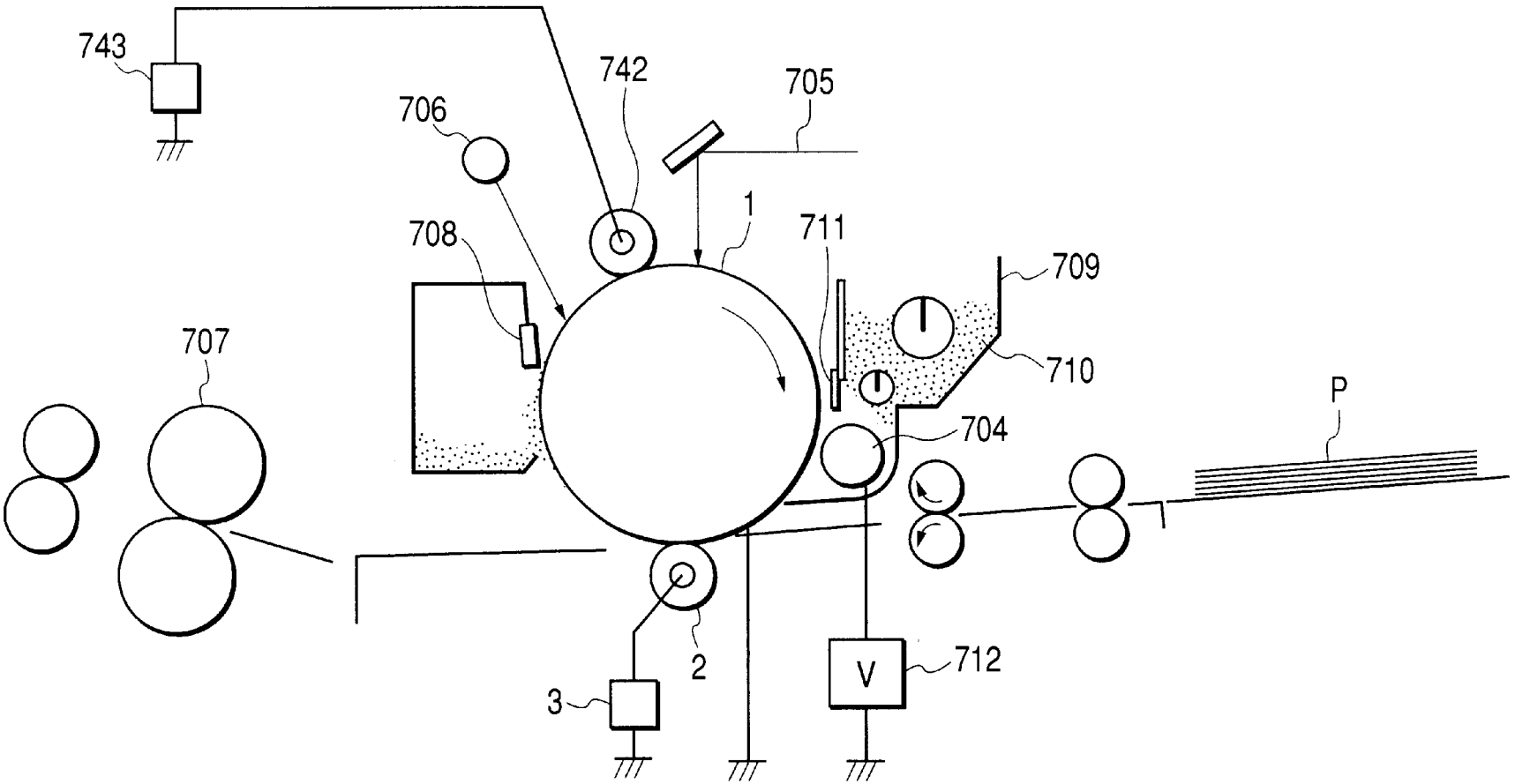
FIG. 1 is a schematic sectional view of an image-forming apparatus according to an embodiment of the present invention.

The present inventors have discovered that good developing performance and running performance can be achieved and also sharp images can be obtained without causing any spots around line images at fixing when, in a toner having at least a binder resin and a colorant, the toner contains as the binder resin at least a vinyl resin selected from the group consisting of i) a vinyl resin having a carboxyl group and a vinyl resin having an epoxy group, ii) a vinyl resin having a carboxyl group and an epoxy group and iii) a vinyl resin produced by the reaction of a carboxyl group with an epoxy group, and the toner has a specific value of dielectric dissipation factor in a specific temperature range.

They have also discovered that the above effect can be more improved when the toner has a specific molecular weight distribution in its molecular weight distribution measured by GPC (gel permeation chromatography) of THF (tetrahydrofuran)-soluble matter in the toner or when the toner has a specific THF-insoluble matter in its binder resin component or when the THF-soluble matter of the toner has a specific acid value.

They have further discovered that, when the present invention is applied to a magnetic toner, good developing performance and running performance can be achieved and also sharp images can be obtained without causing any spots around line images at fixing, by using a magnetic material containing a specific element A in a specific proportion and controlling the quantity value of $\log_{10}(Max/Min) \leqq 2$, and may preferably have a value of $\log_{10}(Max/Min) \leqq 1.5$, and more preferably $\log_{10}(Max/Min) \leqq 1.0$.

The dielectric dissipation factor of the toner of the present invention is a value at a frequency of 1,000 Hz. This value shows dielectric charge polarization at the interfaces between toner particles.

Good developing performance can be achieved when in the dielectric dissipation factor (tan δ) of the toner the value of $\log_{10}(Max/Min)$ is in the above range.

If the value of $\log_{10}(Max/Min)$ is greater than 2, the relaxation of charging with respect to changes in environmental temperature may be too large to maintain any stable charging, resulting in a poor developing performance. Also, spots around line images at fixing may occur and poor dot reproducibility may result. Especially when such a toner is applied to the fixing carried out by the induction heating method, it is affected by the high-frequency magnetic field formed when a high-frequency electric current is flowed to the coil, so that the spots around line images at fixing may seriously occur on the transfer medium. This may remarkably occur when in the developing means an alternating-current bias is applied across the photosensitive member and the developing sleeve.

In the case when the value of $\log_{10}(Max/Min)$ is in the above range of the present invention, the energy of the magnetic material to be liberated into the toner.

Preferred embodiments of the present invention are described below.

As a characteristic feature of the present invention, the toner has at least a binder resin and a colorant, and contains as the binder resin at least a vinyl resin selected from the group consisting of i) a vinyl resin having a carboxyl group and a vinyl resin having an epoxy group, ii) a vinyl resin having a carboxyl group and an epoxy group and iii) a vinyl resin produced by the reaction of a carboxyl group with an epoxy group, and the toner has, in its dielectric dissipation factor (tan δ), at least a maximum value and a minimum value in the temperature range of from 20° C. to 150° C., and, where the maximum value is represented by Max and the minimum value by Min, has a value of $\log_{10}(Max/Min) \leqq 2$. In such a case, good developing performance and running performance can be achieved, and sharp images having less spots around line images at fixing and having good dot reproducibility can be obtained.

In the dielectric dissipation factor (tan δ), the toner of the present invention has at least a maximum value and a minimum value in the temperature range of from 20° C. to 150° C., and, where the maximum value is represented by Max and the minimum value by Min, has a loss under application of an alternating-current electric field (alternating electric field) can be so small that the chargeability of toner particles can be maintained, and this enables image formation in a good reproducibility to the electrostatic latent image formed on the photosensitive member, i.e., in good developing performance and good dot reproducibility.

The same applies also to the fixing carried out by the induction heating method, where the spots around line images at fixing can be kept from occurring on the transfer medium.

The toner of the present invention may preferably have a dielectric dissipation factor (tan δ) of $1.0\times10^{0}$ or smaller, more preferably $5.0\times10^{-1}$ or smaller, and particularly preferably $1.0\times10^{-1}$ or smaller, in the temperature range of from 20° C. to 150° C.

In the case when the toner has a dielectric dissipation factor (tan δ) of $1.0\times10^{0}$ or smaller, good developing performance can be achieved, and the toner exhibits good developing performance especially in an environment of high temperature and high humidity. If the toner has a dielectric dissipation factor (tan δ) larger than $1.0\times10^{0}$, the relaxation of charging with respect to environmental temperature changes may be too large to maintain any stable charging, resulting in a poor developing performance. Also, spots around line images at fixing may occur and poor dot reproducibility may result.

The toner of the present invention has been subjected to heat melt-kneading in the step of kneading in the course of the production of the toner, where a binder resin is brought to cross-linking reaction. In that case, under cross-linking reaction of a carboxyl group unit with an epoxy group unit in the binder resin, a magnetic material containing at least one element A in a specific proportion may be incorporated when the present invention is applied to a magnetic toner. This brings about an improvement in the affinity of the magnetic material for the binder resin to enable achievement of good dispersibility in toner particles. Moreover, the magnetic material can be kept from coming free from the binder resin, so that the magnetic material can be kept less liberated from toner particles.

Since the magnetic material can be kept less liberated from toner particles, the toner can also be improved in charging stability in the developing zone to bring about good dot reproducibility to the electrostatically charged latent image on the photosensitive member. Also, in the fixing carried out by the induction heating method, the toner images held unfixed on the transfer medium may be affected with difficulty by the high-frequency magnetic field formed when a high-frequency electric current is flowed to the coil, so that the spots around line images at fixing may occur less and good dot reproducibility can be attained.

Moreover, in the toner of the present invention, the cross-linking reaction carried out as mentioned above can make the toner itself tough, and, when applied in a high-speed machine, stable running performance can be achieved even where copies are taken in a large volume.

The toner of the present invention may preferably have a THF-soluble matter having an acid value of from 0.1 to 50 mg·KOH/g, more preferably from 0.5 to 50 mg·KOH/g, and particularly preferably from 0.5 to 40 mg·KOH/g. Since the THF-soluble matter of the toner of the present invention has the desired acid value, good developing performance and running performance can be achieved.

If the THF-soluble matter of the toner of the present invention has an acid value smaller than 0.1 mg·KOH/g, there can not be brought about any improvement in dispersibility attributable to the mutual reaction of the carboxyl group with the magnetic material and its accompanying effect of preventing the magnetic material from being liberated from toner particles. If it has an acid value greater than 50 mg·KOH/g, toner particles may have so strong a negative chargeability as to result in poor developing performance when applied in positively chargeable toners.

In the present invention, in molecular weight distribution measured by GPC of THF-soluble matter in the toner, the toner may preferably have a number-average molecular weight (Mn) of from 1,000 to 40,000, more preferably from 2,000 to 20,000, and particularly preferably from 3,000 to 15,000, and may preferably have a weight-average molecular weight (Mw) of from 10,000 to 10,000,000, more preferably from 20,000 to 5,000,000, and particularly preferably from 30,000 to 1,000,000.

In the case when the toner used in the present invention has the above average molecular weights in a chromatogram of GPC of its THF-soluble matter, the toner can retain proper charge quantity and toughness, so that good developing performance and running performance can be achieved.

If the toner has a number-average molecular weight lower than 1,000 or a weight-average molecular weight lower than 10,000, the toner resin may have so low a melt viscosity that the magnetic material may poorly be dispersed in toner particles to provide non-uniform charge distribution, resulting in a poor performance for the prevention of fog and in poor developing performance and running performance. If the toner has a number-average molecular weight higher than 40,000 or a weight-average molecular weight higher than 10,000,000, a high-molecular component and a low-molecular component in the binder resin may have poor compatibility with each other, so that the binder resin itself may have non-uniform component distribution, resulting in a poor dispersibility of the magnetic material and in a poor dot reproducibility.

In the present invention, in molecular weight distribution measured by GPC of THF-soluble matter in the toner, the toner may also preferably have a main peak in the region of molecular weight of from 4,000 to 30,000, and may more preferably have a main peak in the region of molecular weight of from 5,000 to 20,000.

If the toner has a main peak in the region of molecular weight lower than 4,000, the toner resin may have so low a melt viscosity that the magnetic material may poorly be dispersed in toner particles to provide non-uniform charge distribution, so that fog may greatly occur and poor developing performance and running performance may result. If it has a main peak in the region of molecular weight higher than 30,000, the magnetic material may poorly be dispersed in toner particles to provide non-uniform charge distribution, also resulting in a poor dot reproducibility.

In the above molecular weight distribution, the peak area in the region of molecular weight of 30,000 or lower may preferably be in a proportion of from 60 to 100% with respect to the total peak area. In the case when the peak area in the region of molecular weight of 30,000 or lower is within the above range, the magnetic material can well be dispersed in toner particles, and the magnetic material can be kept less liberated from toner particles. If it is less than 60%, the resin may have so high a melt viscosity that the magnetic material may also poorly be dispersed in toner particles, so that the magnetic material may be liberated in a large quantity, resulting in poor developing performance and running performance.

The resin component of the toner of the present invention may also contain THF-insoluble matter in an amount of from 0.1 to 60% by weight, more preferably from 5 to 60% by weight, and particularly preferably from 10 to 45% by weight. In the case when the THF-insoluble matter is within the above range, materials can uniformly be dispersed in toner particles, and good developing performance can be achieved.

If the THF-insoluble matter is more than 60% by weight, materials may poorly be dispersed in toner particles to become non-uniformly chargeable, and hence non-uniform charge distribution may be provided also on the photosensitive member, resulting in a poor dot reproducibility.

The toner of the present invention may preferably have a glass transition temperature (Tg) of from 50 to 70° C. If it has a Tg lower than 50° C., it may have a poor storage stability. If it has a Tg higher than 70° C., it may have a poor fixing performance.

In the present invention, the dielectric dissipation factor is measured under the following conditions.

Measurement of Dielectric Dissipation Factor

Using 4284A Precision LCR Meter (manufactured by Hewlett-Packard Co.), correction is made at frequencies of 1,000 Hz and 1 MHz, and dielectric loss (tan $\delta\in''/\in'$) is calculated from measurements of complex dielectric constant at the frequency of 1,000 Hz.

The toner is weighed in an amount of 1.0 g, which is then molded under application of a load of 19,600 kPa (200 kgf/cm$^2$) for 1 minute to prepare a disk-shaped measuring sample of 25 mm in diameter and 2 mm or less (preferably 0.5 mm to 1.5 mm) in thickness. This measuring sample is attached to ARES (manufactured by Rheometric Scientific F.E. Co.) fitted with a dielectric constant measuring jig (electrode) of 25 mm in diameter, followed by heating to a temperature of 80° C. to melt-fix the sample. Thereafter, this is cooled to a temperature of 20° C., and a load of from 50 to 200 g is applied, in the state of which, keeping the frequency constant at 1,000 Hz, the sample is heated at a heating rate of 2.0° C./minute in the temperature range of from 20° C. to 150° C. to make measurement.

In the present invention, the molecular weight distribution of the toner or binder resin as measured by GPC using THF as a solvent is measured under the following conditions.

Measurement of Molecular Weight Distribution by GPC

Columns are stabilized in a heat chamber of 40° C. To the columns kept at this temperature, THF as a solvent is flowed at a flow rate of 1 ml per minute, and about 100 $\mu$l of a sample THF solution is injected thereinto to make measurement. In measuring the molecular weight of the sample, the molecular weight distribution ascribed to the sample is calculated from the relationship between the logarithmic value and number of count of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from, e.g., Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G10000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way: The sample is put in THF, and is left for several hours, followed by thorough shaking so as to be well mixed with the THF (until coalescent matters of the sample have disappeared), which is further left for at least 12 hours. Here, the sample is so left as to stand in THF for at least 24 hours in total. Thereafter, the solution having been passed through a sample-treating filter (pore size: 0.2 to 0.5 $\mu$m; for example, MAISHORIDISK-25-5, available from Toso Co., Ltd. may be used) is used as the sample for GPC. The sample is so adjusted as to have resin components in a concentration of from 0.5 to 5 mg/ml.

In the present invention, the THF-insoluble matter of the binder resin component in the toner and the THF-insoluble matter of the material binder resin are measured in the following way.

Measurement of THF-insoluble Matter

The toner is weighed in an amount of from 1.0 to 2.0 g (W1 g), which is then put in a cylindrical filter paper (for example, No. 86R, available from Toyo Roshi K.K.) and set on a Soxhlet extractor. Extraction is carried out for 10 hours using 200 ml of THF as a solvent, and the soluble component solution extracted by the use of the solvent is evaporated, followed by vacuum drying at 100° C. for several hours. Then the THF-soluble resin component is weighed (W2 g). The weight of incineration residue ash content is also determined (W3 g).

Incineration residue ash content is determined in the following way. About 2.0 g of a sample is put in a 30 ml magnetic crucible weighed previously precisely, and the sample weight (Wa g) is precisely weighed. The crucible is put in an electric furnace, and is heated at about 900° C. for about 3 hours, followed by leaving to cool in the electric furnace, and then leaving to cool in a desiccator for 1 hour or longer at normal temperature, where the weight of the crucible is precisely weighed. From the weight, the incineration residue ash content (Wb g) is determined.

$$(Wb/Wa)\times 100=\text{Incineration residue ash content (\% by weight)}$$

From this content, the weight of incineration residue ash content (W3 g) is determined The THF-insoluble matter is determined from the following expression.

$$\text{THF-insoluble matter}=[\{W1-(W3+W2)\}/(W1-W3)]\times 100(\%)$$

In the present invention, the acid value (JIS acid value) of the THF-soluble matter and binder resin of the toner is determined in the manner described below. The acid value of the binder resin means the acid value of the THF-soluble matter in the binder resin.

Measurement of Acid Value

Basic operation is made according to JIS K-0070.

(1) A sample is used after the THF-insoluble matter of the toner and binder resin has been removed, or the soluble component obtained in the above measurement of THF-insoluble matter, which has been extracted with THF solvent by means of the Soxhlet extractor, is used as a sample. A crushed product of the sample is precisely weighed in an amount of from 0.5 to 2.0 g, and the weight of the soluble component is represented by W (g).

(2) The sample is put in a 300 ml beaker, and 150 ml of a toluene/ethanol (4/1) mixed solvent is added thereto to dissolve the sample.

(3) Using an ethanol solution of 0.1 mol/l of KOH, titration is made by means of a potentiometric titrator. (For example, automatic titration may be utilized which is made using a potentiometric titrator AT-400, Win Workstation, manufactured by Kyoto Denshi K.K. and an ABP-410 motor buret.)

(4) The amount of the KOH solution used here is represented by S (ml). A blank is measured at the same time, and the amount of the KOH solution used in the blank is represented by B (ml).

(5) The acid value is calculated according to the following expression. Letter symbol f is the factor of KOH.

$$\text{Acid value (mg·KOH/g)}=\{(S-B)\times f\times 5.61\}/W.$$

The glass transition temperature of the toner of the present invention is measured in the following way.

Measurement of Glass Transition Temperature

Measured according to ASTM D3418-82, using a differential scanning calorimeter (DSC measuring instrument) DSC-7, manufactured by Perkin Elmer Co.

A sample for measurement is precisely weighed in an amount of 5 to 20 mg, preferably 10 mg. This sample is put in a pan made of aluminum and an empty aluminum pan is used as reference. Measurement is made in a normal-temperature normal-humidity environment at a heating rate of 10° C./min within the temperature range of from 30° C. to 200° C. In the course of this heating, changes in specific heat are obtained in the temperature range of from 40° C. to 100° C. The point at which the line at a middle point of the base line before and after the appearance of the changes in specific heat thus obtained and the differential thermal curve intersect is regarded as the glass transition point Tg.

In the present invention, the toner contains at least a vinyl resin selected from the group consisting of i) a vinyl resin having a carboxyl group and a vinyl resin having an epoxy group, ii) a vinyl resin having a carboxyl group and an epoxy group and iii) a vinyl resin produced by the reaction of a carboxyl group with an epoxy group.

As a monomer having a carboxyl group unit that constitutes the vinyl resin having a carboxyl group, it may include the following.

The monomer having a carboxyl group unit may include, e.g., acrylic acids such as acrylic acid, methacrylic acid, α-ethylacrylic acid, crotonic acid, cinnamic acid, vinylacetic acid, isocrotonic acid, tiglic acid and angelic acid, and anhydrides or α- or β-alkyl derivatives of these; and unsaturated dicarboxylic acids such as fumaric acid, maleic acid, citraconic acid, alkenylsuccinic acids, itaconic acid, mesaconic acid, dimethylmaleic acid and dimethylfumaric acid, and monoester derivatives, anhydrides or α- or β-alkyl derivatives of these.

The monomer having such a carboxyl group unit may be used alone or in the form of a mixture, and may be copolymerized with other vinyl monomer by a known polymerization method to obtain the vinyl resin having a carboxyl group.

The vinyl resin having a carboxyl group may preferably have an acid value of from 0.5 to 60 mg·KOH/g. If it has an acid value smaller than 0.5 mg·KOH/g, the sites at which the carboxyl group and the epoxy group undergo cross-linking reaction are so few that the vinyl resin has only few cross-linking components to make it difficult for the toner to exhibit its running performance. In such a case, a vinyl resin having an epoxy group with a high epoxy value may be used to make compensation to a certain extent. If the vinyl resin having a carboxyl group has an acid value greater than 60 mg·KOH/g, the binder resin in toner particles may have so strong a negative chargeability as to tend to result in a decrease in image density and an increase in fog when applied in positively chargeable toners.

The vinyl resin having a carboxyl group may preferably have a glass transition temperature (Tg) of from 40° C. to 70° C. If it has a Tg lower than 40° C., the toner may have poor anti-blocking properties. If it has a Tg higher than 70° C., the toner may have a poor fixing performance.

In the vinyl resin having a carboxyl group, it may preferably have a number-average molecular weight of from 1,000 to 40,000 in order to achieve good fixing performance and developing performance, and may preferably have a weight-average molecular weight of from 10,000 to 10,000,000 in order to achieve good anti-offset properties, anti-blocking properties and running performance.

The vinyl resin having a carboxyl group may preferably be constituted of a low-molecular-weight component and a high-molecular-weight component. The low-molecular-weight component may preferably have a peak molecular weight of from 4,000 to 30,000 in order to achieve good fixing performance. The high-molecular-weight component may preferably have a peak molecular weight of from 100,000 to 1,000,000 in order to achieve good anti-offset properties, anti-blocking properties and running performance.

Polymerization methods that can be used in the present invention as a method for synthesizing the high-molecular weight component copolymer may include bulk polymerization, solution polymerization, emulsion polymerization and suspension polymerization.

Of these, the emulsion polymerization is a method in which monomers almost insoluble in water are dispersed with an emulsifying agent in an aqueous phase in the form of small particles to carry out polymerization using a water-soluble polymerization initiator. This method enables easy control of reaction heat, and requires only a small rate of termination reaction since the phase where the polymerization is carried out (an oily phase formed of polymers and monomers) is separate from the aqueous phase, so that a product with a high polymerization concentration and a high degree of polymerization can be obtained. Moreover, since the polymerization process is relatively simple and the polymerization product is in the form of fine particles, colorants, charge control agents and other additives can be mixed with ease when the toner is produced. Thus, this has an advantage as a production process for binder resins for toners.

However, the polymer tends to become impure because of the emulsifying agent added, and an operation such as salting-out is required to take out the polymer. In order to avoid such difficulties, solution polymerization and suspension polymerization are advantageous.

In the suspension polymerization, the reaction may preferably be carried out using monomers in an amount of not more than 100 parts by weight, and preferably from 10 to 90 parts by weight, based on 100 parts by weight of an aqueous solvent. Usable dispersants include polyvinyl alcohol, partially saponified polyvinyl alcohol, and calcium phosphate, any of which may usually be used in an amount of from 0.05 to 1 part by weight based on 100 parts by weight of the aqueous solvent. Polymerization temperature may be from 50 to 95° C. as a suitable range, and may appropriately be selected depending on the initiator used and the intended polymer.

In order to achieve the object of the present invention, the high-molecular weight polymer used in preparing the resin composition may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, having a polymerization initiating function, as exemplified by 1,1-di-t-butylperoxy-3,3,5-trimethylcyclohexane, 1,3-bis(t-butylperoxyisopropyl)

benzene, 2,5-dimethyl-2,5-(t-butylperoxy)hexane, 2,5-dimethyl-2,5-di-(t-butylperoxy)hexane, tris-(t-butylperoxy) triazine, 1,1-di-t-butylperoxycyclohexane, 2,2-di-t-butylperoxybutane, 4,4-di-t-butylperoxyvaleric acid-n-butyl ester, di-t-butyl peroxyhexahydroterephthalate, di-t-butyl peroxyazelate, di-t-butyl peroxytrimethyladipate, 2,2-bis(4,4-di-t-butylperoxycyclohexyl)propane, 2,2-di-t-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, t-butyl peroxymaleate, t-butylperoxyallyl carbonate, and t-butylperoxyisopropyl fumarate.

Of these, more preferred ones are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis(4,4-di-t-butylperoxycyclohexyl)propane, and t-butylperoxyallyl carbonate.

In order to satisfy various performances required as binders for the toner, any of these polyfunctional polymerization initiators may preferably be used in combination with a monofunctional polymerization initiator. In particular, they may preferably be used in combination with a polymerization initiator having a half-life of 10 hours which is lower than the decomposition temperature necessary for the polyfunctional polymerization initiator to obtain a half-life of 10 hours.

Such a monofunctional polymerization initiator may specifically include organic peroxides such as benzoylperoxide, 1,1-bis(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumene, and di-t-butyl peroxide; and azo or diazo compounds such as azobisisobutylonitrile and diazoaminoazobenzene.

Any of these monofunctional polymerization initiators may be added in the monomers at the same time the polyfunctional polymerization initiator is added. In order to keep a proper efficiency of the polyfunctional polymerization initiator, the monofunctional polymerization initiator may preferably be added after the half-life the polyfunctional polymerization initiator shows has lapsed in the polymerization step.

Any of these polymerization initiators may preferably be added in an amount of 0.01 to 10 parts by weight based on 100 parts by weight of the monomers, in view of efficiency.

As methods for synthesizing the low-molecular-weight component, known methods may be used. In bulk polymerization, polymers with a low-molecular weight can be obtained by polymerizing monomers at a high temperature and accelerating the rate of termination reaction, but there is the problem of a difficulty in controlling the reaction. In this regard, in solution polymerization, low-molecular weight polymers can be obtained with ease under mild conditions, utilizing a difference in chain transfer of radicals that is caused by a solvent, and controlling the quantity of initiators and the reaction temperature. Thus, this method is preferred in order to obtain the low-molecular weight polymer in the vinyl resin having a carboxyl group.

As the solvent used in the solution polymerization, xylene, toluene, cumene, cellosolve acetate, isopropyl alcohol or benzene may be used. Where styrene monomers are used, xylene, toluene or cumene is preferred. The solvent may appropriately be selected depending on the polymer to be produced. As to reaction temperature, which may differ depending on the solvent and polymerization initiator to be used and the polymer to be produced, the reaction may be carried out usually at 70° C. to 230° C. In the solution polymerization, the monomer may preferably be used in an amount of from 30 to 400 parts by weight based on 100 parts by weight of the solvent.

It is also preferable to further mix other polymers in the solution when the polymerization is terminated. Several kinds of polymers may be mixed.

The epoxy group in the vinyl resin having an epoxy group is meant to be a functional group in which an oxygen atom is united with two carbon atoms in the same molecule, and has a cyclic ether structure. The cyclic ether structure may typically include rings of 3 members, 4 members, 5 members and 6 members. In particular, those of 3-member ring structure are preferred.

As a monomer having an epoxy group unit that constitutes the vinyl resin having an epoxy group, it may include the following.

It may include glycidyl acrylate, glycidyl methacrylate, β-methylglycidyl acrylate, β-methylglycidyl methacrylate, allyl glycidyl ether and allyl β-methylglycidyl ether. A glycidyl monomer represented by Formula (1) below may also preferably be used.

Formula (1)

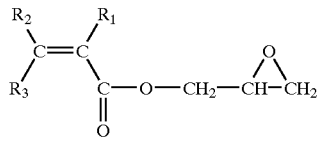

In Formula (1), $R_1$, $R_2$ and $R_3$ each represent a hydrogen atom, an alkyl group, an aryl group, an aralkyl group, a carboxyl group or an alkoxycarbonyl group.

The monomer having such an epoxy group unit may be used alone or in the form of a mixture, and may be copolymerized with other vinyl monomer by a known polymerization method to obtain the vinyl resin having an epoxy group.

The vinyl resin having an epoxy group may preferably have a weight-average molecular weight (Mw) of from 2,000 to 100,000, more preferably from 2,000 to 50,000, and still more preferably from 3,000 to 40,000. If it has an Mw lower than 2,000, its molecular weight may increase because of the cross-linking reaction in the binder resin, and a large number of molecules may be cut in the kneading step, resulting in a poor running performance. If it has an Mw higher than 100,000, it may affect fixing performance.

Its epoxy value may preferably be from 0.05 to 5.0 eq/kg. If it is lower than 0.05 eq/kg, the cross-linking reaction may proceed with difficulty, and the high-molecular-weight component or THF-insoluble matter may be formed in a small quantity to make the toner have a low strength. If it is higher than 5.0 eq/kg, the cross-linking reaction may proceed with ease but on the other hand a large number of molecules may be cut in the kneading step, resulting in poor dispersion of the magnetic material.

In the vinyl resin having an epoxy group used in the present invention, the epoxy group may preferably be in a mixing proportion of from 0.01 to 10.0 equivalent weight, and more preferably from 0.03 to 5.0 equivalent weight, based on 1 equivalent weight of the carboxyl group in the vinyl resin having a carboxyl group.

If the epoxy group is less than 0.01 equivalent weight, the cross-linking points may be so few in the binder resin that the effect attributable to cross-linking reaction, such as running performance, may be brought out with difficulty. If it is more than 10 equivalent weight, the cross-linking reaction may take place with ease but on the other hand poor dispersion may result because of, e.g., the formation of excessive THF-insoluble matter, to cause a poor pulyerizability and a problem on the stability of development.

The epoxy value of the vinyl resin having an epoxy group is determined in the following way.

Measurement of Epoxy Value

Basic operation is made according to JIS K-7236.

(1) A sample is precisely weighed in an amount of from 0.5 to 2.0 g, and its weight is represented by W (g).

(2) The sample is put in a 300 ml beaker, and is dissolved in a mixture of 10 ml of chloroform and 20 ml of acetic acid.

(3) To the resultant solution, 10 ml of tetraethylammonium bromide acetic acid solution is added. Using an acetic acid solution of 0.1 mol/l of perchloric acid, titration is made by means of a potentiometric titrator. (For example, automatic titration may be utilized which is made using a potentiometric titrator AT-400, Win Workstation, manufactured by Kyoto Denshi K.K. and an ABP-410 motor buret.) The amount of the acetic acid solution of perchloric acid used here is represented by S (ml). A blank is measured at the same time, and the amount of the acetic acid solution of perchloric acid used in the blank is represented by B (ml).

The epoxy value is calculated from the following expression. Letter symbol f is the factor of acetic acid solution of perchloric acid.

$$\text{Epoxy value (eq/kg)}=0.1\times f\times(S-B)/W.$$

In the vinyl resin having a carboxyl group and an epoxy group, it may preferably have a number-average molecular weight of from 10,000 to 40,000 in order to achieve good developing performance and running performance, and may preferably have a weight-average molecular weight of from 10,000 to 10,000,000 in order to achieve good anti-offset properties, anti-blocking properties and running performance.

The vinyl resin having a carboxyl group and an epoxy group is obtained by mixing a monomer having a carboxyl group unit and a monomer having an epoxy group unit, and copolymerizing the mixture with other vinyl monomer by a known polymerization method.

In the present invention, a vinyl resin may also be used which is obtained by previously reacting the vinyl resin having a carboxyl group with the vinyl resin having an epoxy group when the resin is produced. As a means for the reaction, (1) the vinyl resin having a carboxyl group and the vinyl resin having an epoxy group may be mixed in the state of a solution, followed by heating in a reaction vessel to cause the cross-linking reaction to take place, or (2) the vinyl resin having a carboxyl group and the vinyl resin having an epoxy group may each be taken out of a reaction vessel, and may be dry-blended by means of a Henschel mixer or the like, followed by heat melt-kneading by means of a twin extruder or the like to cause the cross-linking reaction to take place.

In the case when the above vinyl resin obtained by reacting the vinyl resin having a carboxyl group with the vinyl resin having an epoxy group is used, it may preferably contain from 0.1 to 60% by weight of THF-insoluble matter. In the case when it contains the THF-insoluble matter in the above range, the resin itself can have an appropriate melt viscosity in the kneading step, and hence uniform dispersion of materials can be achieved.

If its THF-insoluble matter is more than 60% by weight, the resin itself may have so high a melt viscosity as to make poor the dispersion of materials.

The vinyl monomer copolymerized with the monomer having a carboxyl group unit and the monomer having an epoxy group unit may include the following.

The monomer other than the monomer having a carboxyl group unit and the monomer having an epoxy group unit may include, e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, 1-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in combination of two or more monomers.

Of these, monomers may preferably be used in such a combination that may give a styrene copolymer and a styrene-acrylic copolymer. In this case, in view of fixing performance and mixing properties, such monomers may preferably contain at least 65% by weight of a styrene copolymer component or a styrene-acrylic copolymer component.

As the binder resin used in the toner of the present invention, the following other polymer may also be added.

For example, usable are homopolymers of styrene or styrene derivatives such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins.

In order to make the toner used in the present invention hold positive chargeability or negative chargeability, the toner may preferably be incorporated with a charge control agent.

Charge control agents capable of controlling the toner to be positively chargeable include the following materials.

For example, they include Nigrosine and modified products of Nigrosine, modified with a fatty metal salt; quaternary ammonium salts such as tributylbenzylammonium 1-hydroxy-4-naphthosulfonate and tetrabutylammonium tetrafluoroborate and analogues of these, i.e., onium salts such as phosphonium salts, and lake pigments of these, triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; as well as guanidine compounds, and imidazole compounds. Any of these may be used alone or in combination of two or more types. Of these, triphenylmethane dyes, imidazole compounds, and quaternary ammonium salts whose counter ions are not halogens may preferably be used.

Charge control agents capable of controlling the toner to be negatively chargeable may include the following materials.

For example, organic metal complexes or chelate compounds are effective, which include monoazo metal complexes, acetylacetone metal complexes, aromatic hydroxycarboxylic acid metal complexes and aromatic dicarboxylic acid metal complexes. Besides, they include aromatic hydroxycarboxylic acid, aromatic monocarboxylic or polycarboxylic acids and metal salts, anhydrides or esters thereof, and phenol derivatives such as bisphenol.

As methods for incorporating the charge control agent in the toner, there are a method of adding it internally to toner particles and a method of adding it externally to toner particles. The amount of the charge control agent used depends on the type of the binder resin, the presence of any other additives, and the manner by which the toner is produced, including the manner of dispersion, and can not be absolutely specified. Preferably, the charge control agent may be used in an amount ranging from 0.1 to 10 parts by weight, and more preferably from 0.1 to 5 parts by weight, based on 100 parts by weight of the binder resin.

In the present invention, in order to impart release properties to the toner, a wax as shown below may preferably be incorporated in the toner. It is a wax having a melting point of from 70 to 165° C., and a melt viscosity of 1,000 mPa·s or lower at 160° C. As specific examples, it may include paraffin wax, microcrystalline wax, Fischer-Tropsch wax and montan wax; and also homopolymers or copolymers of straight-chain α-olefins such as ethylene, propylene, butene, pentene, hexene, heptene, octene, nonene and decene, branched α-olefins having a branched moiety at the terminal, and olefins having these unsaturated groups at different positions. Besides, alcohol waxes, fatty acid waxes, ester waxes and naturally occurring waxes may also be used.

Also usable are modified waxes, made into block copolymers with vinyl monomers or subjected to graft modifications, and oxidized waxes, subjected to oxidation treatment.

Any of these waxes may previously be added and mixed in a polymer component when the toner is produced. In such a case, a method is preferred in which, when the polymer component is prepared, the wax and a high-molecular polymer are preliminarily dissolved in a solvent and thereafter the resultant solution is mixed with a low-molecular polymer solution. By this method, phase separation at microscopic regions can be relaxed, the high-molecular polymer component can be kept from undergoing re-agglomeration, and also a good state of dispersion with the low-molecular polymer can be achieved.

The wax may also preferably be added in an amount of from 0.5 to 10 parts by weight, and more preferably from 1 to 8 parts by weight, based on 100 parts by weight of the binder resin. Also, the wax may be added using two or more types of waxes in combination.

As a colorant usable in the present invention, it may include any suitable pigments and dyes. For example, the pigments include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by weight, and preferably from 0.2 to 10 parts by weight, based on 100 parts by weight of the binder resin. The dyes may also be used for the same purpose, and include, e.g., azo dyes, anthraquinone dyes, xanthene dyes and methine dyes, any of which may be added in an amount of from 0.1 to 20 parts by weight, and preferably from 0.3 to 10 parts by weight, based on 100 parts by weight of the binder resin.

In the toner of the present invention, a magnetic material may be used as the colorant so that the toner can be used as a magnetic toner.

It has been discovered that, in the case when a magnetic material is used as the colorant in the toner of the present invention, the magnetic material can be kept from being liberated from toner particles when at least one element A belonging to the third and following periods of the long form of the periodic table and having an electronegativity of from 1.0 to 2.5 is contained in the magnetic material in an amount of from 0.1 to 4.0% by weight on the basis of Fe.

This is presumed to be the fact that the incorporation of the carboxyl group, epoxy group or acid anhydride group in the binder resin and the element A in the magnetic material enables the magnetic material to have higher affinity and to be well dispersed in toner particles, by virtue of mutual action with the binder resin having the functional group, so that the magnetic material can be kept from falling from the toner particles.

The element A incorporated in the magnetic material may preferably be made present in such a state that the element A has been replaced at crystal lattices of magnetic ion oxide, and any of elements A belonging to the third and following periods of the long form of the periodic table may preferably be used.

The element A may preferably be an element belonging to the third period, the fourth period or the fifth period, and more preferably be an element belonging to the third period or the fourth period. The element A may preferably have an electronegativity close to that of the iron element [1.83 for iron (II), 1.96 for iron (III)]. Accordingly, the element A may have an electronegativity of from 1.0 to 2.5, preferably from 1.2 to 2.3, and more preferably from 1.5 to 2.1, as Pauling's electronegativity.

Stated specifically, preferred elements A are Al (1.61), Si (1.90), P (2.19), Ti (1.54), V (1.63), Cr (1.66), Mn (1.55), Co (1.88), Ni (1.91), Cu (2.00), Zn (1.65), Ga (1.81), Ge (2.01), Zr (1.33), Sn (1.80) and Pb (1.87). More preferred ones are Al, Si, Ti, Mn and Zn.

The element A in the magnetic material may preferably be in a content of from 0.1 to 4.0% by weight on the basis of Fe. In the case when it is within this range, the toner can be improved in developing performance and running performance, and the magnetic material can be kept from being liberated from toner particles. Especially when the element A is Al, Si, Ti or Mn, the toner can exhibit good developing performance even in an environment of high temperature and high humidity.

If the element A is in a content smaller than 0.1% by weight, the toner may be charged in excess and may have non-uniform charge distribution to cause fog. If it is in a content larger than 4.0% by weight, it tends to affect magnetic characteristics to have great influence on developing performance undesirably.

In the present invention, the content of the element A in the magnetic material is measured in the following way.

Measurement of Content of Element A in Magnetic Material

The content of the element A in the magnetic material used in the present invention is measured by fluorescent X-ray analysis according to JIS K0119 "General Rules for Fluorescent X-ray Analysis", using a fluorescent X-ray analyzer SYSTEM 3080 (manufactured by Rigaku Denki Kogyo K.K.).

In the toner of the present invention, the magnetic material standing liberated into the toner may preferably be present in a number of from 70 to 500 particles per 10,000 toner particles.

A case in which the magnetic material standing liberated is less than 70 particles indicates that substantially no magnetic material stands liberated. In such a case, the toner tends to cause charge-up because of an increase in charge quantity of the toner, resulting in a low image density and a poor developing performance. Also, if it is more than 500 particles, the toner may have so great a value of dielectric dissipation factor that not only the toner may have a low charge quantity to have a poor developing performance, but also the abrasion of photosensitive member and the melt adhesion of toner which accompanies such abrasion tend to occur. In addition, the magnetic material may become accumulated in excess in the step of cleaning to cause faulty cleaning to bring about stained images.

Especially in the fixing making use of the induction heating method, the toner standing unfixed on the transfer medium may scatter, resulting in a poor dot reproducibility of the image having been fixed.

In the present invention, the number of particles of the magnetic material standing liberated is measured in the following way.

Measurement of Number of Particles of Magnetic Material Standing Liberated

Herein, "the number of particles of the magnetic material standing liberated" is a value measured with a particle analyzer (PT1000, manufactured by Yokogawa Denki K.K.), and is measured on the basis of the principle described in Japan Hardcopy '97 Papers, pages 65–68. Stated specifically, in this analyzer, fine particles such as toner particles are individually led into plasma, and the element (s), number of particles and particle diameter of particles of light-emitting matter can be known from emission spectra of the fine particles.

For example, considering a case in which toner particles are led into plasma, when led into plasma the light emission of carbon which is a constituent element of the binder resin and the light emission of iron atoms present in the magnetic material are individually observed for each toner particle. More specifically, since one light emission is attained per one toner particle, the number of toner particles can be determined from the number (number of times) of light emissions. Here, light emission of iron atoms having emitted light within 2.6 msec after the light emission of carbon atoms is regarded as simultaneous light emission, and light emission of iron atoms after that is regarded as light emission of only iron atoms. Since in the toner of the present invention the magnetic material is contained in a large quantity, what is meant by the fact of simultaneous light emission of carbon atoms and iron atoms is that the magnetic material stands dispersed in the toner particles, and the light emission of only iron atoms can be said to mean that the magnetic material stands liberated from toner particles.

A specific measuring method therefor is as follows: Measurement is made in an environment of 23° C. and 60% humidity, using a sample having been moisture conditioned by leaving overnight in the same environment. More specifically, carbon atoms are measured in channel 1 (measurement wavelength: 247.86 nm), and iron atoms in channel 2 (measurement wavelength: 239.56 nm; K-factor: 3.3764). Sampling is so carried out that the number of light emissions of carbon atoms comes to 1,000 to 1,400 times in one scanning, and the scanning is repeated until the number of light emission of carbon atoms comes to 10,000 times or more in total, where the number of light emissions is calculated by addition.

Here, the measurement is made by sampling carried out in such a way that, in distribution given by plotting the number of light emissions of carbon element as ordinate and the cubic-root voltage of iron element as abscissa, the distribution has one peak and also no valley is present. Then, on the basis of the data thus obtained, the number of liberated particles of the iron is calculated, setting the noise-cut level of all elements at 1.50 V.

In some cases, compounds other than inorganic compounds containing iron atoms, such as an azo type iron complex used as a charge control agent, are also contained in the toner particles. However, such compounds are not counted as free iron atoms because, as long as they are organic metal compounds containing carbon atoms, the carbon atoms in such organic compounds also emit light simultaneously with iron atoms and hence the light emission of only iron atoms can not occur.

The magnetic material may preferably have a number average particle diameter of from 0.05 to 1.0 $\mu$m, more preferably from 0.1 to 0.6 $\mu$m, and particularly preferably from 0.1 to 0.4 $\mu$m.

The number-average particle diameter is determined as follows:

Using an electron microscope H-700H (manufactured by Hitachi, Ltd.), particles of magnetic material are photographed at 50,000×, the photograph taken is printed at 2×, thus the final magnifications are 100,000×. 100 particles having a maximum length of 0.03 $\mu$m or more are arbitrarily selected from the photograph, their maximum lengths ($\mu$m) are measured, and the mean of the maximum lengths measured is regarded as the number-average particle diameter.

In the present invention, the magnetic material may be incorporated in the toner in an amount of from 10 to 200 parts by weight, preferably from 20 to 170 parts by weight, and more preferably from 30 to 150 parts by weight, based on 100 parts by weight of the binder resin.

In the toner of the present invention, it is preferable to add fine silica powder in order to improve charge stability, developing performance, fluidity and running performance.

The fine silica powder used in the present invention may have a specific surface area of 30 $m^2/g$ or larger, and particularly in the range of from 50 to 400 $m^2/g$, as measured by nitrogen adsorption according to the BET method. Such powder gives good results. The fine silica powder may be used in an amount of from 0.01 to 8 parts by weight, and preferably from 0.1 to 5 parts by weight, based on 100 parts by weight of the toner.

For the purpose of making hydrophobic, controlling chargeability and so forth, it is preferable for the fine silica powder used in the present invention, to have optionally been treated with a treating agent such as a silicone varnish, a modified silicone varnish of various types, a silicone oil, a modified silicone oil of various types, a silane coupling agent, a silane compound having a functional group, or other organosilicon compound, or treated with various treating agents used in combination.

Other external additives may also optionally be added to the toner of the present invention.

They are exemplified by a charging auxiliary agent, a conductivity-providing agent, a fluidity-providing agent, an anti-caking agent, and fine resin particles or inorganic fine particles which act as a release agent, a lubricant or an abrasive at the time of heat-roller fixing.

For example, the lubricant may include Teflon, zinc stearate and polyvinylidene fluoride; in particular, polyvinylidene fluoride is preferred. The abrasive may include cerium oxide powder, silicon carbide powder and strontium titanate powder; in particular, strontium titanate is preferred. The fluidity-providing agent may include titanium oxide powder and aluminum oxide powder; in particular, hydrophobic one is preferred. The conductivity-providing agent may include carbon black powder, zinc oxide powder, antimony oxide powder and tin oxide powder. White fine particles and black fine particles having opposite polarity may also be used as a developing performance improver in a small quantity.

To produce the toner of the present invention, the binder resin, the magnetic material and other additives may thoroughly be mixed by means of a mixing machine such as a Henschel mixer or a ball mill, and then the mixture obtained may be melt-kneaded by means of a heat kneading machine such as a heat roll, a kneader or an extruder, followed by cooling for solidification and thereafter pulverization and classification. Any desired additive(s) may further optionally thoroughly be mixed by means of a mixing machine such as a Henschel mixer. Thus, the toner of the present invention can be obtained.

As the mixing machine, it may include, e.g., Henschel Mixer (manufactured by Mitsui Mining & Smelting Co., Ltd.); Super Mixer (manufactured by Kawata K.K.); Ribocone (manufactured by Ohkawara Seisakusho K.K.); Nauta Mixer, Turbulizer and Cyclomix (manufactured by Hosokawa Micron K.K.); Spiral Pin Mixer (manufactured by Taiheiyo Kiko K.K.); and Rhedige Mixer (manufactured by Matsubo K.K.). As the kneading machine, it may include KRC Kneader (manufactured by Kurimoto Tekkosho K.K.); Buss Co-kneader (manufactured by Buss Co.); TEM-type Extruder (manufactured by Toshiba Machine Co., Ltd.); TEX Twin-screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-type Pressure Kneader, Kneader Ruder (manufactured by Moriyama Seisakusho K.K.); and Banbury Mixer (manufactured by Kobe Seikosho K.K.). As a grinding machine, it may include Counter Jet Mill, Micron Jet and Inomizer (manufactured by Hosokawa Micron K.K.); IDS-type Mill and PJM Jet Grinding Mill (manufactured by Nippon Pneumatic Kogyo K.K.); Cross Jet Mill (manufactured by Kurimoto Tekkosho K.K.); Ulmax (manufactured by Nisso Engineering K.K.); SK Jet O-Mill (manufactured by Seishin Kigyo K.K.); Criptron (manufactured by Kawasaki Heavy Industries, Ltd); and Turbo Mill (manufactured by Turbo Kogyo K.K.). As a classifier, it may include Classyl, Micron Classifier and Spedic Classifier (manufactured by Seishin Kigyo K.K.); Turbo Classifier (manufactured by Nisshin Engineering K.K.); Micron Separator, Turboprex(ATP) and TSP Separator (manufactured by Hosokawa Micron K.K.); Elbow Jet (manufactured by Nittestsu Kogyo K.K.); Dispersion Separator (manufactured by Nippon Pneumatic Kogyo K.K.); and YM Microcut (manufactured by Yasukawa Shoji K.K.). As a sifter used to sieve coarse powder and so forth, it may include Ultrasonic (manufactured by Koei Sangyo K.K.); Rezona Sieve and Gyrosifter (manufactured by Tokuju Kosakusho K.K.); Vibrasonic System (manufactured by Dulton Co.); Soniclean (manufactured by Shinto Kogyo K.K.); Turbo Screener (manufactured by Turbo Kogyo K.K.); Microsifter (manufactured by Makino Sangyo K.K.); and circular vibrating screens.

The image-forming apparatus of the present invention is described below with reference to FIG. 1. The scope of the present invention is by no means limited thereto. FIG. 1 is a schematic sectional view of the image-forming apparatus.

In FIG. 1, reference numeral 1 denotes a rotating drum type photosensitive member, which is clockwise rotated as viewed in the drawing, at a stated peripheral speed (process speed). Reference numeral 742 denotes a charging roller, which is brought into pressure contact with the surface of the photosensitive member 1 at a given pressure, and is follow-up rotated as the photosensitive member 1 is rotated. Reference numeral 743 denotes a charging bias power source for applying a voltage to the charging roller 742 to cause the surface of the photosensitive member 1 to be charged to stated polarity and potential. Imagewise exposure 705 subsequently carried out gives formation of electrostatic latent images, which are then developed by a developing means and successively rendered visible as toner images.

The charging process carried out using the charging roller may preferably be under conditions of a roller contact pressure of 5 to 500 N/m, an AC voltage of 500 to 5,000 Vpp, an AC frequency of 50 to 5,000 Hz and a DC voltage of plus-minus 0.2 to plus-minus 1,500 V when a voltage formed by superimposing an AC voltage on a DC voltage is used; and a DC voltage of from plus-minus 0.2 to plus-minus 1,500 V when a DC voltage is applied.

To a developing sleeve 704 constituting the developing means, a development bias V1 is applied from a development bias power source 712. As the development bias, an AC bias, a pulse bias and/or a DC bias is used. The toner image formed on the photosensitive member is electrostatically transferred to a transfer medium P (transfer paper) by means of a transfer roller 2 serving as a contact transfer means to which a transfer bias is kept applied from a transfer bias power source 3, and is heat and pressure fixed by means of a fixing roller 707 which is a heat-and-pressure means. After the toner image has been transferred, the surface of the photosensitive member 1 is cleaned by removing adhered contaminants such as transfer residual toner, by means of a cleaning unit having an elastic cleaning blade 708 brought into pressure contact with the photosensitive member 1 in the counter direction, and is further destaticized by a charge elimination exposure unit 706 so as to be repeatedly used for image formation.

The development bias applied to the developing sleeve 704 from the development bias power source 712 is, in the case of the AC bias, used at an AC frequency ranging from 200 to 4,000 Hz, and Vpp, from 500 to 3,000 V.

When magnetic toner particles are moved to the surface of the photosensitive member at the developing zone, the magnetic toner particles are moved to the electrostatic-image side, i.e., to the surface of the photosensitive member by an electrostatic force on the photosensitive member surface and by the action of the AC bias or pulse bias.

In the case when the toner of the present invention is applied in the above image-forming apparatus, the electric-field response of the toner under application of an alternating electric field across the photosensitive member and the developing sleeve is so good that the toner exhibits good developing performance and dot reproducibility with respect to the electrostatic latent image formed on the photosensitive member. In particular, the fog and deterioration in dot reproducibility can be kept from occurring even when a large Vpp is applied, and any selective development can be controlled in an environment where in-machine temperature becomes higher when applied in a high-speed machine.

In the foregoing description, the charging roller 742 is used as a primary charging means which is a contact charging means as described above. It may also be a contact charging means such as a charging blade or a charging brush. It may still also be a non-contact corona charging means. However, the contact charging method is preferred in view of an advantage that the charging may cause less generation of ozone.

In the foregoing description, the transfer roller 2 is used as a transfer means. It may also be a contact transfer means such as a transfer belt, and may still also be a non-contact corona transfer means. However, the contact transfer method is preferred in this case, too, in view of an advantage that the transfer may cause less generation of ozone.

The process cartridge of the present invention is described below. The scope of the present invention is by no means limited thereto.

Figure 2:
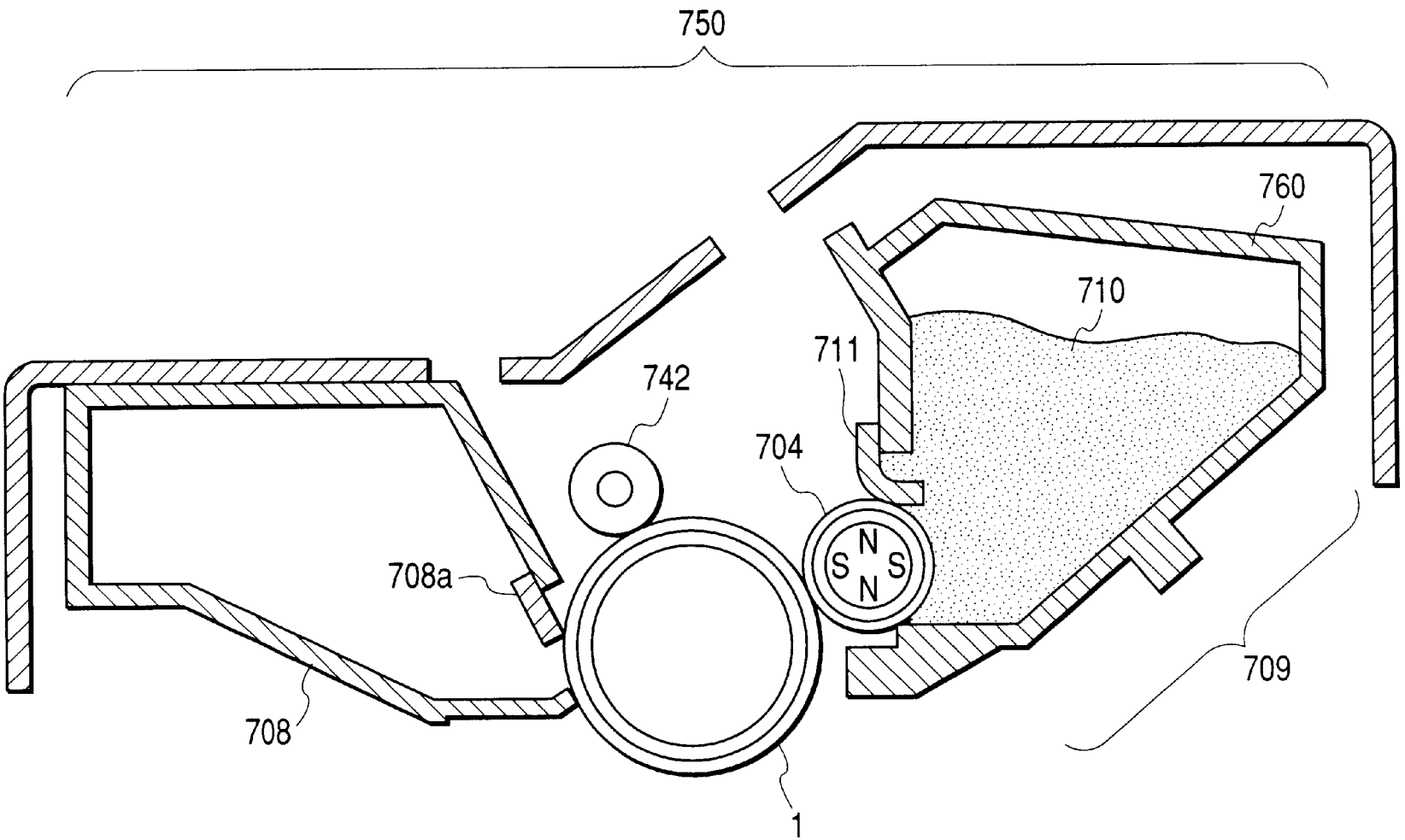
FIG. 2 is a schematic sectional view of a process cartridge according to an embodiment of the present invention.

The process cartridge according to the present invention is described with reference to FIG. 2. FIG. 2 is a schematic sectional view of the process cartridge. Incidentally, in the illustration in FIG. 2, corresponding parts are shown also in FIG. 1.

The process cartridge has at least a developing means and an electrostatic-image-bearing member which are held into one unit as a cartridge, and is so set up as to be detachable from the main body of an image forming apparatus (e.g., a copying machine or a laser beam printer).

In FIG. 2, shown is a process cartridge 750 having a developing means 709, a drum-type electrostatic-image-bearing member (photosensitive drum) 1, a cleaner 708 having a cleaning blade 708*a*, and a primary charging assembly (charging roller) 742, which are held into one unit.

The developing means 709 also has a magnetic blade 711 and a toner container 760 holding a magnetic toner 710. At the time of development, a stated electric field is formed across the photosensitive drum 1 and a developing sleeve 704 by a bias applied from a bias applying means, and the toner participates in development on the photosensitive drum holding the electrostatic latent image thereon.

A preferred heat fixing unit used in the image-forming method of the present invention is described below. The scope of the present invention is by no means limited thereto.

Figure 3:
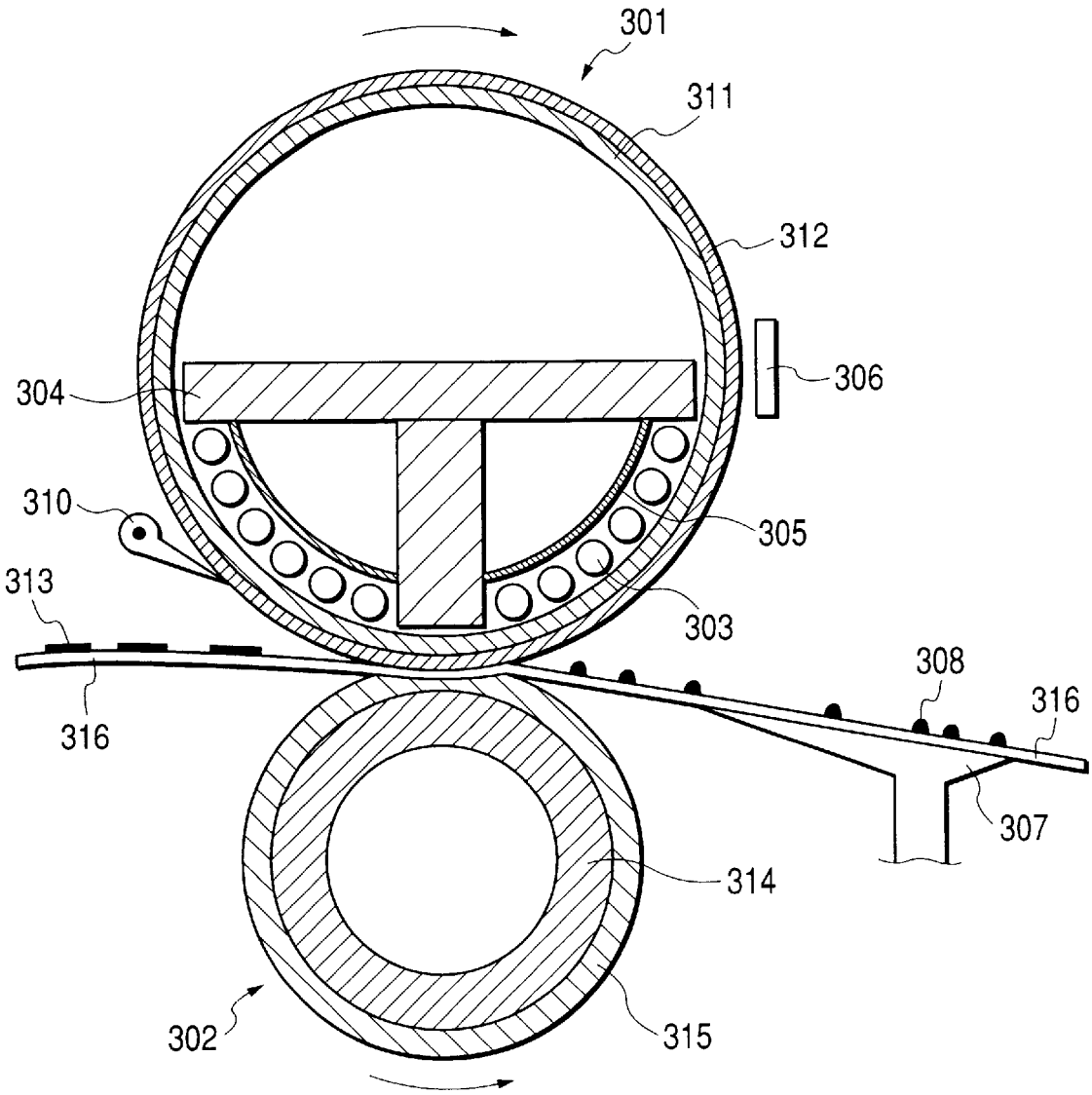
FIG. 3 is a schematic sectional view showing the construction of a fixing unit according to an embodiment of the present invention.

The heat fixing unit according to the present invention is described with reference to FIG. 3. FIG. 3 is a schematic sectional view showing the construction of the fixing unit.

A fixing roller 301 as a rotary heating member is constituted of, e.g., a roll cylinder 311 (heat generation layer) made of iron, having an outer diameter of 40 mm and a wall thickness of 0.7 mm, and is provided on its surface with, e.g., a 10 to 50 $\mu$m thick PTFE (polytetrafluoroethylene) layer or 10 to 50 $\mu$m thick PFA (perfluoroalkoxyfluoro resin) layer 312 as a release layer in order to improve release properties of the surface.

A pressure roller 302 as a rotary pressure member comprises a hollow roll 314 and an elastic layer 315 which is a surface releasable heat-resistant rubber layer formed on the periphery of the former. At both ends of this pressure roller 302, bearings are formed through which the pressure roller 302 is rotatably attached to a fixing unit frame. The fixing roller 301 and the pressure roller 302 are rotatably supported and are so constructed that only the fixing roller 301 is driven. The pressure roller 302 is kept in pressure contact with the surface of the fixing roller 301 and is so disposed that it is follow-up rotated by a frictional force acting at a pressure contact zone (nip). Also, the pressure roller 302 is pressed against the fixing roller 301 in the direction of the latter's rotating shaft by a mechanism (not shown) making use of, e.g., a spring. The pressure roller 302 may be pressed against the rotary fixing member (fixing roller) under a load of about 294 N/m (about 30 kg in weight). Under such a load of 294 N/m, the width of the pressure contact zone (nip width) is set at about 6 mm. Of course, the nip width may be changed by changing the load taking account of service conditions.

A temperature sensor 306 is so disposed as to come into contact with the surface of the fixing roller 301, and the power supply to an exciting coil 303 serving as an exciting means (magnetic field generation means) is changed in accordance with detected signals of the temperature sensor 306 so that the surface temperature of the fixing roller 301 can automatically be controlled to a stated constant temperature.

A transport guide 307 is disposed in such position that a transfer medium 316 which is transported holding thereon an unfixed toner image 308 is guided to the nip between the fixing roller 301 and the pressure roller 302.

A separation claw 310 is disposed in contact with or proximity to the surface of the fixing roller 301, and prevents the transfer medium 316 from winding around the fixing roller 301.

The exciting coil 303 is provided on the outside of a holder 305 made of a heat-resistant resin such as PPS (polyphenylene sulfide), PEEK (polyether ether ketone) or phenol resin, in such a structure that a conductor wire is wound around the middle projected portion of a magnetic-substance core (hereinafter "core") 304 having a T-shaped cross section and extends along the inner periphery of the fixing roller 301. An alternating current of 10 to 100 kHz is applied to the exciting coil 303. A magnetic field induced by the alternating current is guided to the core 304 serving as a magnetic-field barrier means having a high permeability, to produce a magnetic flux and an eddy current on the inner surface of the fixing roller 301 serving as a heat-generating means, and Joule heat is further produced by the specific resistance of the fixing roller 301. In order to increase this heat generation, the number of winding of the exciting coil 303 may be made larger, or a material having a high permeability and a low residual magnetic flux density, such as ferrite or Permalloy may be used, or the frequency of the alternating current may be made higher. Incidentally, the core 304 extends in the direction of the rotating shaft of the fixing roller 301 and is so constructed as to have the T-shaped cross section so that the magnetic field produced by the exciting coil 303 upon its excitation can be shut off to converge the magnetic field toward the heating zone.

When, with construction as described above, the surface temperature of the fixing roller 301 is controlled to a preset temperature of 190° C., which is optimum for the fixing, an electric power of about 200 W must be supplied to the exciting coil 303. In such a case, the temperature of the exciting coil reaches about 210° C., and the temperature of the magnetic-substance core about 200° C.

When fixing is performed continuously and in a large volume at a rate of about 30 sheets per minute, an electric power of about 450 W must be supplied to the exciting coil. In such a case, the temperature of the exciting coil reaches about 230° C., and the temperature of the magnetic-substance core about 220° C. Accordingly, the magnetic-substance core must have a Curie temperature of 220° C. or higher taking account of the case in which fixing is performed continuously and in a large volume. If the temperature of the magnetic-substance core exceeds its Curie temperature (the temperature at which it shifts from ferromagnetic to paramagnetic), an extreme lowering of electric power/heat generation conversion efficiency may result at the part the former has exceeded the latter.

In the foregoing description, shown is a case in which the fixing roller is used as the rotary heating member. In place of the fixing roller, a thin-film metal film may of course be employed to set up the unit.

EXAMPLES

The present invention is described below in greater detail by giving Examples specifically. The present invention is by no means limited to these.

Production Example A-1 of High-Molecular Component

| | (by weight) |
|---|---|
| Styrene | 78.4 parts |
| n-Butyl acrylate | 19.6 parts |
| Methacrylic acid | 2.0 parts |
| 2,2-Bis(4,4-di-t-butylperoxycyclohexyl)propane | 0.8 part |

In a four-necked flask, with stirring of 200 parts by weight of xylene, the inside of the container was well displaced with nitrogen and was heated to 120° C., and thereafter the above materials were dropwise added thereto over a period of 4 hours. Under further reflux of xylene, polymerization was completed, and the solvent was evaporated off under reduced pressure. The resin thus obtained is designated as resin A-1.

Production Example A-2 of High-Molecular Component

Resin A-2 was obtained in the same manner as in Production Example A-1 except that the materials used therein were changed to 79.7 parts by weight of styrene, 19.9 parts by weight of n-butyl acrylate, 0.4 part by weight of acrylic acid and 0.8 part by weight of 2,2-bis(4,4-di-t-butylperoxycyclohexyl)propane.

Production Example A-3 of High-Molecular Component

Resin A-3 was obtained in the same manner as in Production Example A-1 except that the materials used therein were changed to 76.8 parts by weight of styrene, 19.2 parts by weight of n-butyl acrylate, 2.8 parts by weight of methacrylic acid, 1.0 part by weight of glycidyl methacrylate and 0.8 part by weight of 2,2-bis(4,4-di-t-butylperoxycyclohexyl)propane.

Production Example A-4 of High-Molecular Component

Resin A-4 was obtained in the same manner as in Production Example A-1 except that the materials used therein were changed to 75.2 parts by weight of styrene, 18.8 parts by weight of n-butyl acrylate, 6.0 parts by weight of methacrylic acid and 0.8 part by weight of 2,2-bis(4,4-di-t-butylperoxycyclohexyl)propane.

Production Example A-5 of High-Molecular Component

Resin A-5 was obtained in the same manner as in Production Example A-1 except that the materials used therein were changed to 74.4 parts by weight of styrene, 18.6 parts by weight of n-butyl acrylate, 7 parts by weight of acrylic acid and 0.8 part by weight of 2,2-bis(4,4-di-t-butylperoxycyclohexyl)propane.

Production Example A-6 of High-Molecular Component

Resin A-6 was obtained in the same manner as in Production Example A-1 except that the materials used therein were changed to 80 parts by weight of styrene, parts by weight of n-butyl acrylate and 1 part by weight of 20 2,2-bis(4,4-di-t-butylperoxycyclohexyl)propane.

Production Example A-7 of High-Molecular Component

Resin A-7 was obtained in the same manner as in Production Example A-1 except that the materials used therein were changed to 72.8 parts by weight of styrene, 18.2 parts by weight of n-butyl acrylate, 9 parts by weight of acrylic acid and 0.8 part by weight of 2,2-bis(4,4-di-t-butylperoxycyclohexyl)propane.

Production Example B-1 of Vinyl Resin Having Carboxyl Groups

| | (by weight) |
|---|---|
| High-molecular component resin A-1 | 30 parts |
| Styrene | 55.4 parts |
| n-Butyl acrylate | 13.9 parts |
| Methacrylic acid | 0.7 part |
| Di-t-butyl peroxide | 1.4 parts |

The above materials were dropwise added to 200 parts by weight of xylene over a period of 4 hours. Under further reflux of xylene, polymerization was completed, and the solvent was evaporated off under reduced pressure. The resin thus obtained is designated as resin B-1.

Production Example B-2 of Vinyl Resin Having Carboxyl Groups

Resin B-2 was obtained in the same manner as in Production Example B-1 except that the materials used therein were changed to 30 parts by weight of high-molecular component resin A-2, 56 parts by weight of styrene, 14 parts by weight of n-butyl acrylate and 1.4 parts by weight of di-t-butyl peroxide.

Production Example B-3 of Vinyl Resin Having Carboxyl Groups

Resin B-3 was obtained in the same manner as in Production Example B-1 except that the materials used therein were changed to 30 parts by weight of high-molecular component resin A-3, 56 parts by weight of styrene, 14 parts by weight of n-butyl acrylate and 1.4 parts by weight of di-t-butyl peroxide.

Production Example B-4 of Vinyl Resin Having Carboxyl Groups

Resin B-4 was obtained in the same manner as in Production Example B-1 except that the materials used therein were changed to 30 parts by weight of high-molecular component resin A-4, 53.6 parts by weight of styrene, 13.4 parts by weight of n-butyl acrylate, 3.0 parts by weight of methacrylic acid and 1.4 parts by weight of di-t-butyl peroxide.

Production Example B-5 of Vinyl Resin Having Carboxyl Groups

Resin B-5 was obtained in the same manner as in Production Example B-1 except that the materials used therein were changed to 30 parts by weight of high-molecular component resin A-5, 52.8 parts by weight of styrene, 13.2 parts by weight of n-butyl acrylate, 4 parts by weight of acrylic acid and 1.4 parts by weight of di-t-butyl peroxide.

Production Example B-6 of Vinyl Resin Not Having Carboxyl Groups

Resin B-6 was obtained in the same manner as in Production Example B-1 except that the materials used therein were changed to 50 parts by weight of high-molecular component resin A-6, 40 parts by weight of styrene, 10 parts by weight of n-butyl acrylate and 1.0 part by weight of di-t-butyl peroxide.

Production Example B-7 of Vinyl Resin Having Carboxyl Groups

Resin B-7 was obtained in the same manner as in Production Example B-1 except that the materials used therein were changed to 30 parts by weight of high-molecular component resin A-7, 52.8 parts by weight of styrene, 13.2 parts by weight of n-butyl acrylate, 4.0 parts by weight of acrylic acid and 1.4 parts by weight of di-t-butyl peroxide.

Production Example B-8 of Vinyl Resin Having Carboxyl Groups

Resin B-8 was obtained in the same manner as in Production Example B-1 except that the materials used therein were changed to 50 parts by weight of high-molecular component resin A-2, 40 parts by weight of styrene, 10 parts by weight of n-butyl acrylate and. 1.0 part by weight of di-t-butyl peroxide.

Production Example C-1 of Vinyl Resin Having Epoxy Groups

| | (by weight) |
|---|---|
| Styrene | 79.2 parts |
| n-Butyl acrylate | 19.8 parts |
| Glycidyl methacrylate | 1 part |
| Di-t-butyl peroxide | 5 parts |

In a four-necked flask, with stirring of 200 parts by weight of xylene, the inside of the container was well displaced with nitrogen and was heated to 120° C., and thereafter the above materials were dropwise added thereto over a period of 4 hours. Under further reflux of xylene, polymerization was completed, and the solvent was evaporated off under reduced pressure. The resin thus obtained is designated as resin C-1.

Production Example C-2 of Vinyl Resin Having Epoxy Groups

Resin C-2 was obtained in the same manner as in Production Example C-1 except that the materials used therein were changed to 72 parts by weight of styrene, 18 parts by weight of n-butyl acrylate, 10 parts by weight of glycidyl methacrylate and 5 parts by weight of di-t-butyl peroxide.

Synthesis Example D-1 of Magnetic Material

In to a reaction vessel holding therein 20 liters of an aqueous solution of 3.0 mol/liter of sodium hydroxide, 20 liters of an aqueous ferrous sulfate solution having 1.5 mol/liter of $Fe^{2+}$ was introduced, followed by heating to a temperature of 95° C. to form a ferrous-salt suspension containing a ferrous hydroxide colloid. To this suspension, 0.2 liters of an aqueous sodium silicate solution having 28 g of silicon content was dropwise added over a period of 60 minutes with aeration at a rate of 100 liters per minute. Thereafter, the mixture formed was stirred for 30 minutes to obtain a magnetite-containing ferrous suspension. To this suspension, an aqueous solution of 6.0 mol/liter of sodium hydroxide was added to adjust its pH to 10.0. Further, 0.1 liters of sodium silicate having 28 g of silicon content was dropwise added thereto over a period of 30 minutes with aeration at a rate of 100 liters per minute, followed by stirring for 30 minutes to form magnetite particles. To the magnetite particles obtained, 150 ml of an aqueous solution of 0.5 mol/liter of aluminum sulfate was added and thoroughly stirred, and then the magnetite was separated by filtration. The magnetite thus obtained was washed with water and then dried, followed by disintegration to obtain magnetic material 1. The magnetic material 1 synthesized in this Synthesis Example D-1 contains 1.0% by weight of Si and 0.2% by weight of Al on the basis of Fe.

Synthesis Example D-2 of Magnetic Material

The procedures of Synthesis Example D-1 were repeated but changing the types and amounts of metal salts added, to obtain magnetic material 2 containing 2.5% by weight of Ti and 1.0% by weight of Mn on the basis of Fe.

Synthesis Example D-3 of Magnetic Material

The procedures of Synthesis Example D-1 were repeated but changing the types and amounts of metal salts added, to obtain magnetic material 3 containing 0.3% by weight of Si and 2.5% by weight of Ti on the basis of Fe.

Synthesis Example D-4 of Magnetic Material

The procedures of Synthesis Example D-1 were repeated but changing the types and amounts of metal salts added, to obtain magnetic material 4 containing 0.5% by weight of Si and 0.8% by weight of Ti on the basis of Fe.

Synthesis Example D-5 of Magnetic Material

The procedures of Synthesis Example D-1 were repeated but changing the types and amounts of metal salts added, to obtain magnetic material 5 containing 1.0% by weight of Si on the basis of Fe.

Synthesis Example D-6 of Magnetic Material

The procedures of Synthesis Example D-1 were repeated but changing the types and amounts of metal salts added, to obtain magnetic material 6 containing 0.05% by weight of Ti on the basis of Fe.

Synthesis Example D-7 of Magnetic Material

An aqueous solution of sodium hydroxide in 0.95 equivalent weight on the basis of $Fe^{2+}$ was mixed in a ferrous sulfate solution, and thereafter an aqueous ferrous-salt solution containing $Fe(OH)_2$ was formed.

Thereafter, sodium silicate was so added as to be in an amount of 1.0% by weight in terms of silicon element on the basis of iron element. Then, the aqueous ferrous-salt solution containing $Fe(OH)_2$ was aerated at a temperature of 90° C. to effect oxidation reaction under conditions of pH 6 to 7.5.

To the suspension formed, an aqueous sodium hydroxide solution in which 0.1% by weight (in terms of silicon element on the basis of iron element) of sodium silicate had been dissolved was further added in an amount of 1.05 equivalent weight on the basis of residual $Fe^{2+}$, the oxidation was further carried out under conditions of pH 6 to 7.5 with heating at a temperature of 90° C., to form magnetite containing the silicon element.

The magnetite thus formed was washed, followed by filtration and drying, by conventional methods. Primary particles of the magnetite thus obtained stood agglomerated to form agglomerates, and hence compression force and shear force were applied to the agglomerates of magnetite by means of a mix muller to disintegrate the magnetite, obtaining magnetic material 7. The magnetic material 7 synthesized in this Synthesis Example D-7 contains 1.1% by weight of Si on the basis of Fe.

Example 1

90 parts by weight of the vinyl resin having carboxyl groups which was obtained in Production Example B-1 and 10 parts by weight of the vinyl resin having epoxy groups which was obtained in Production Example C-1 were mixed by means of a Henschel mixer. Thereafter, the mixture obtained was kneaded at 180° C. by means of a twin-screw extruder, followed by cooling and pulverization to obtain binder resin 1.

| | |
|---|---|
| Binder resin 1 obtained above | 100 parts |
| Magnetic material 1 | 90 parts |
| Polyethylene wax | 4 parts |
| Triphenylmethane lake pigment | 2 parts |

The above materials were well premixed by means of a Henschel mixer. Thereafter, the mixture obtained was melt-kneaded by means of a twin-screw extruder set at 130° C. The kneaded product obtained was cooled, and then crushed using a cutter mill. Thereafter, the crushed product was finely pulverized by means of a fine grinding mill making use of jet streams. The resultant finely pulverized product was classified by means of an air classifier to obtain a classified fine powder (toner particles) having a weight-average particle diameter of 7.5 $\mu$m.

To 100 parts by weight of the classified fine powder thus obtained, 0.8 part by weight of hydrophobic silica obtained by treating 100 parts by weight of a dry-process fine silica powder (BET specific surface area: 200 $m^2/g$) with 17 parts by weight of amino-modified silicone oil (amine equivalent weight: 830; viscosity at 25° C.: 70 cSt) was added, and these were mixed by means of a Henschel mixer, followed by sieving with a filter having a mesh size of 150 $\mu$m to obtain toner 1.

Figure 4:
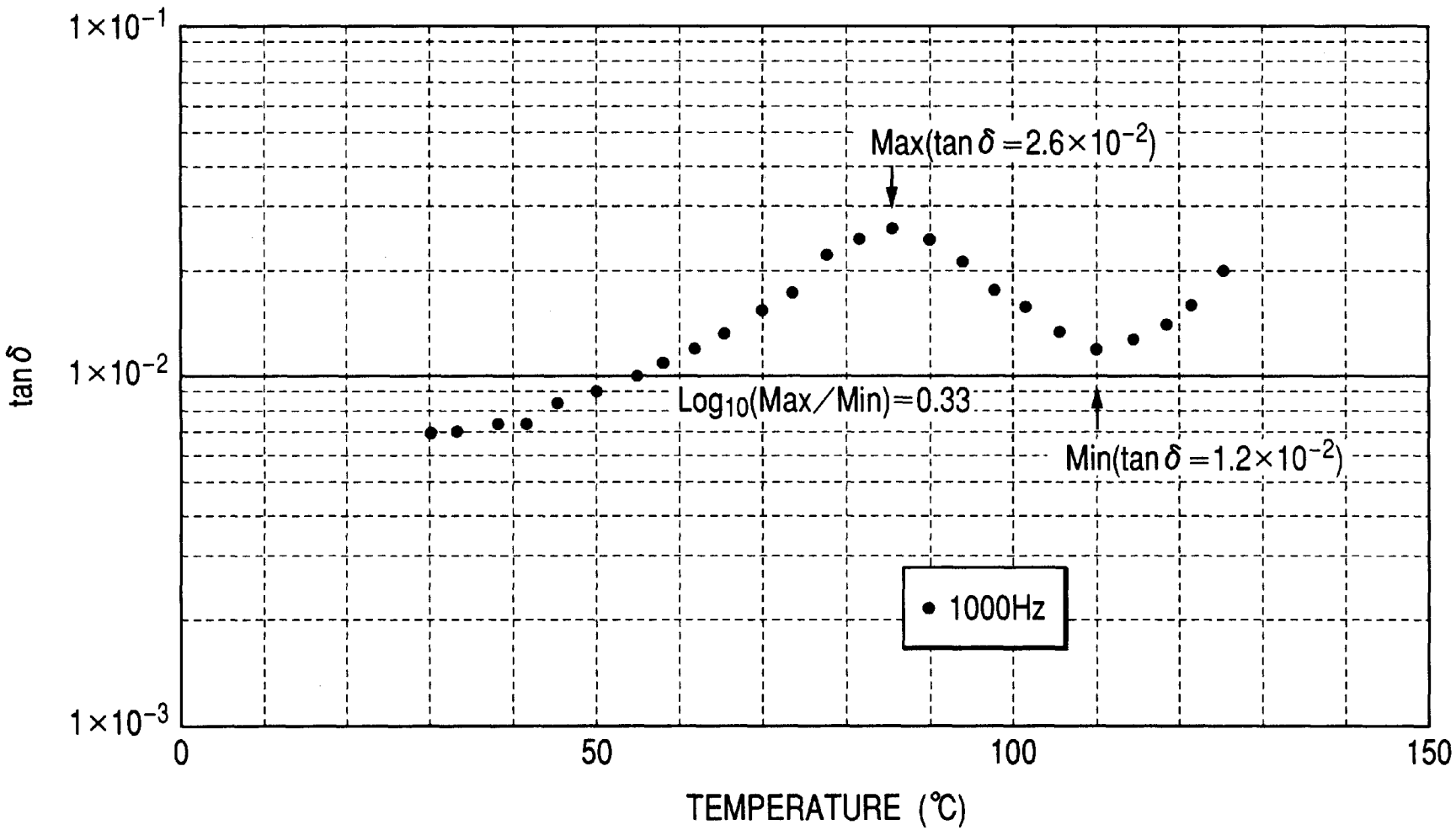
FIG. 4 is a graph showing dielectric dissipation factor characteristics in Example 1 of the present invention.

Physical properties of the toner are shown together in Table 1. A measuring chart of the dielectric dissipation factor of this toner is shown in FIG. 4.

With respect to the toner 1 thus obtained, the following evaluation tests were made. "Evaluation A" is evaluation made using an apparatus having a fixing unit of a halogen lamp type. "Evaluation B" is evaluation made using an apparatus having a fixing unit of an induction heating type.

Evaluation A

Image Evaluation Test

Using a commercially available copying machine GP-605 (manufactured by CANON INC.; AC bias of Vpp=1,000 V and f=2,700 Hz applied; fixing by a halogen lamp method; process speed: 300 mm/sec), copies of a test chart having a print percentage (image area percentage) of 6% were taken on 100,000 sheets in a normal temperature/normal humidity environment (N/N; 23° C./60%RH), and copies of a test chart having a print percentage (image area percentage) of 6% were taken on 50,000 sheets in each of a normal temperature/low humidity environment (N/L; 23° C./5%RH) and a high temperature/high humidity environment (H/H; 30° C./80%RH) to make image evaluation with respect to image density, fog, dot reproducibility, and stained images caused by faulty cleaning or toner melt adhesion.

The image density was measured with "Macbeth Reflection Densitometer" (manufactured by Macbeth Co.). With respect to the fog, the reflection density of transfer paper and the reflection density of transfer paper after the copying of a solid white image were measured with "Reflection Densitometer" (manufactured by Tokyo Denshoku Gijutsu Center K.K.), and a difference between them was regarded as fog value.

The dot reproducibility was evaluated in the following way: A latent image of a block check pattern (checkered pattern) constituted of one dot, two dots, three dots and four dots was formed on the photosensitive member through a laser, and this image was used as a measuring sample. This sample was observed with a magnifier, and the dot reproducibility was judged by the number of dot(s) of an image where the block check pattern was clearly recognizable. It shows that the smaller this number is, the better the dot reproducibility is.

With respect to the stained images, evaluation was made by visual observation of images formed.

AA (excellent): No stained image appears at all.

A (good): Minute stains appear, but no problem in practical use.

B (passable): Spot-like and line-like stains appear, repeating appearance and disappearance.

C (failure): Stains appear, and do not disappear.

The results of image evaluation on these are shown together in Table 2.

Evaluation B

Image Evaluation Test

Using a remodeled machine of a commercially available copying machine GP-605 (manufactured by CANON INC.) which was so remodeled that the AC bias values of the developing part were changed to Vpp=2,000 V and f=3,000 Hz, the fixing assembly part was changed to the electromagnetic induction heating fixing unit shown in FIG. 3 and the process speed was set at 520 mm/sec, copies of a test chart having a print percentage (image area percentage) of 6% were taken on 100,000 sheets in a normal temperature/normal humidity environment (N/N; 23° C./60%RH), and copies of a test chart having a print percentage (image area percentage) of 6% were taken on 50,000 sheets in each of a normal temperature/low humidity environment (N/L; 23° C./5%RH) and a high temperature/high humidity environment (H/H; 30° C./80%RH) to make image evaluation with respect to image density, fog, dot reproducibility, and stained images caused by faulty cleaning or toner melt adhesion. Also, in this test machine, the heat generation layer of the rotary heating member was in a thickness of 6 mm, and the rotary pressure member was in contact with it at a nip width of 8.0 mm and a linear pressure of 100,000 N/m.

The image density was measured with "Macbeth Reflection Densitometer" (manufactured by Macbeth Co.). With respect to the fog, the reflection density of transfer paper and the reflection density of transfer paper after the copying of a solid white image were measured with "Reflection Densitometer" (manufactured by Tokyo Denshoku Gijutsu Center K.K.), and a difference between them was regarded as fog value.

The dot reproducibility was evaluated in the following way: A latent image of a block check pattern (checkered pattern) constituted of one dot, two dots, three dots and four dots was formed on the photosensitive member through a laser, and developed. Thereafter, the toner image formed was transferred to a transfer medium, which was then passed through an external fixing assembly set up as shown in FIG. 2, which was so remodeled as to have a process speed of 520 mm/sec. The fixed image thus obtained was used as a measuring sample. Here, the surface temperature of the upper fixing roller was set at 190° C. This sample was observed with a magnifier, and the dot reproducibility was judged by the number of dot(s) of an image where the block check pattern was clearly recognizable. It shows that the smaller this number is, the better the dot reproducibility is.

With respect to the stained images, evaluation was made by visual observation of images formed.

AA (excellent): No stained image appears at all.

A (good): Minute stains appear, but no problem in practical use.

B (passable): Spot-like and line-like stains appear, repeating appearance and disappearance.

C (failure): Stains appear, and do not disappear.

Fixing Performance Test

The fixing unit as shown in FIG. 3 was remodeled into an external fixing assembly in such a way that it was operable also outside the copying machine, its fixing temperature was able to be arbitrarily set, the heat generation layer of the rotary heating member was in a thickness of 6 mm and the rotary pressure member was in contact with it at a nip width of 8.0 mm and a linear pressure of 100,000 N/m. Using this fixing assembly, unfixed toner images transferred onto sheets of paper of 80 g/m$^2$ basis weight were fixed to evaluate fixing performance. Temperature was controlled at intervals of 5° C. in the temperature range of from 140 to 190° C., and the unfixed toner images were fixed at each temperature. The images thus obtained were back and forth rubbed five times with Silbon paper under a load of 4.9 kPa. The point at which the rate of decrease in image density before and after the rubbing came to 10% was regarded as fixing start temperature. The lower this temperature is, the better the fixing performance is.

Anti-offset Properties Evaluation Test

The fixing unit as shown in FIG. 3 was remodeled into an external fixing assembly in such a way that it was operable also outside the copying machine, its fixing temperature was able to be arbitrarily set, the heat generation layer of the rotary heating member was in a thickness of 6 mm and the rotary pressure member was in contact with it at a nip width of 8.0 mm and a linear pressure of 100,000 N/m. Using this fixing assembly, unfixed toner images transferred onto sheets of paper of 50 g/m$^2$ basis weight were fixed to evaluate fixing performance. Temperature was controlled at intervals of 5° C. in the temperature range of from 190 to 240° C., and occurrence of offset was observed, measuring the temperature at which the offset occurred (evaluation environment: normal temperature/normal humidity environment of 23° C./60%RH). Also, as to the transfer paper, images were formed on its felt side (the side having smooth paper surface) to make the test.

The results of image and performance evaluation on these are shown together in Table 3.

Example 2

90 parts by weight of the vinyl resin having carboxyl groups which was obtained in Production Example B-2 and 10 parts by weight of the vinyl resin having epoxy groups which was obtained in Production Example C-2 were mixed by means of a Henschel mixer. The mixture obtained was kneaded at 180° C. by means of a twin-screw extruder, followed by cooling and pulverization to obtain binder resin 2.

Toner 2 was obtained in the same manner as in Example 1 except that the binder resin 1 was changed to the binder resin 2. Evaluation was likewise made on this toner 2. Physical properties of the toner are shown together in Table 1, and the results of evaluation in Tables 2 and 3.

Example 3

90 parts by weight of the vinyl resin having carboxyl groups which was obtained in Production Example B-3 and 10 parts by weight of the vinyl resin having epoxy groups which was obtained in Production Example C-1 were mixed by means of a Henschel mixer. The mixture obtained was kneaded at 180° C. by means of a twin-screw extruder, followed by cooling and pulverization to obtain binder resin 3.

Toner 3 was obtained in the same manner as in Example 1 except that the binder resin 1 was changed to the binder resin 3. Evaluation was likewise made on this toner 3. Physical properties of the toner are shown together in Table 1, and the results of evaluation in Tables 2 and 3.

Example 4

95 parts by weight of the vinyl resin having carboxyl groups which was obtained in Production Example B-4 and 5 parts by weight of the vinyl resin having epoxy groups which was obtained in Production Example C-1 were mixed by means of a Henschel mixer. The mixture obtained was kneaded at 180° C. by means of a twin-screw extruder, followed by cooling and pulverization to obtain binder resin 4.

Toner 4 was obtained in the same manner as in Example 1 except that the binder resin 1 was changed to the binder resin 4. Evaluation was likewise made on this toner 4. Physical properties of the toner are shown together in Table 1, and the results of evaluation in Tables 2 and 3.

Example 5

95 parts by weight of the vinyl resin having carboxyl groups which was obtained in Production Example B-5 and 5 parts by weight of the vinyl resin having epoxy groups which was obtained in Production Example C-1 were mixed by means of a Henschel mixer. The mixture obtained was kneaded at 170° C. by means of a twin-screw extruder, followed by cooling and pulverization to obtain binder resin 5.

Toner 5 was obtained in the same manner as in Example 1 except that the binder resin 1 was changed to the binder resin 5. Evaluation was likewise made on this toner 5. Physical properties of the toner are shown together in Table 1, and the results of evaluation in Tables 2 and 3.

Comparative Example 1

90 parts by weight of the vinyl resin not having any carboxyl groups which was obtained in Production Example B-6 and 10 parts by weight of the vinyl resin having epoxy groups which was obtained in Production Example C-1 were mixed by means of a Henschel mixer. The mixture obtained was kneaded at 180° C. by means of a twin-screw extruder, followed by cooling and pulverization to obtain binder resin 6.

Toner 6 was obtained in the same manner as in Example 1 except that the binder resin 1 was changed to the binder resin 6. Evaluation was likewise made on this toner 6. Physical properties of the toner are shown together in Table 1, and the results of evaluation in Tables 2 and 3.

Example 6

90 parts by weight of the vinyl resin having carboxyl groups which was obtained in Production Example B-7 and 10 parts by weight of the vinyl resin having epoxy groups which was obtained in Production Example C-2 were mixed by means of a Henschel mixer. The mixture obtained was kneaded at 200° C. by means of a twin-screw extruder, followed by cooling and pulverization to obtain binder resin 7.

Toner 7 was obtained in the same manner as in Example 1 except that the binder resin 1 was changed to the binder resin 7. Evaluation was likewise made on this toner 7. Physical properties of the toner are shown together in Table 1, and the results of evaluation in Tables 2 and 3.

Example 7

Toner 8 was obtained in the same manner as in Example 1 except that the magnetic material 1 was changed to the magnetic material 2. Evaluation was likewise made on this toner 8. Physical properties of the toner are shown together in Table 1, and the results of evaluation in Tables 2 and 3.

Example 8

Toner 9 was obtained in the same manner as in Example 1 except that the magnetic material 1 was changed to the magnetic material 3. Evaluation was likewise made on this toner 9. Physical properties of the toner are shown together in Table 1, and the results of evaluation in Tables 2 and 3.

Example 9

Toner 10 was obtained in the same manner as in Example 1 except that the magnetic material 1 was changed to the magnetic material 4. Evaluation was likewise made on this toner 10. Physical properties of the toner are shown together in Table 1, and the results of evaluation in Tables 2 and 3.

Example 10

Toner 11 was obtained in the same manner as in Example 1 except that the magnetic material 1 was changed to the magnetic material 5. Evaluation was likewise made on this toner 11. Physical properties of the toner are shown together in Table 1, and the results of evaluation in Tables 2 and 3.

Comparative Example 2

90 parts by weight of the vinyl resin having carboxyl groups which was obtained in Production Example B-5 and 10 parts by weight of the vinyl resin having epoxy groups which was obtained in Production Example C-2 were mixed by means of a Henschel mixer. The mixture obtained was kneaded at 200° C. by means of a twin-screw extruder, followed by cooling and pulverization to obtain binder resin 8.

Toner 12 was obtained in the same manner as in Example 1 except that the binder resin 1 was changed to the binder resin 8. Evaluation was likewise made on this toner 12. Physical properties of the toner are shown together in Table 1, and the results of evaluation in Tables 2 and 3.

Comparative Example 3

90 parts by weight of the vinyl resin having carboxyl groups which was obtained in Production Example B-8 and 10 parts by weight of the vinyl resin having epoxy groups which was obtained in Production Example C-2 were mixed by means of a Henschel mixer. The mixture obtained was kneaded at 200° C. by means of a twin-screw extruder, followed by cooling and pulverization to obtain binder resin 9.

Toner 13 was obtained in the same manner as in Example 1 except that the binder resin 1 was changed to the binder resin 9. Evaluation was likewise made on this toner 13. Physical properties of the toner are shown together in Table 1, and the results of evaluation in Tables 2 and 3.

Example 11

Toner 14 was obtained in the same manner as in Example 1 except that the magnetic material 1 was changed to the magnetic material 6. Evaluation was likewise made on this toner 14. Physical properties of the toner are shown together in Table 1, and the results of evaluation in Tables 2 and 3.

Example 12

| | |
|---|---|
| Binder resin 1 | 100 parts |
| Magnetic material 7 | 100 parts |
| Polyethylene wax | 4 parts |
| Monoazo iron complex | 2 parts |

The above materials were well premixed by means of a Henschel mixer. Thereafter, the mixture obtained was melt-kneaded by means of a twin-screw extruder set to 140° C. The kneaded product obtained was cooled, and then crushed using a cutter mill. Thereafter, the crushed product was finely pulverized by means of a fine grinding mill making use of jet streams. The resultant finely pulverized product was classified by means of an air classifier to obtain a classified fine powder (toner particles) having a weight-average particle diameter of 6.7 μm.

To 100 parts by weight of the classified fine powder thus obtained, 1.2 parts by weight of hydrophobic silica obtained by treating 100 parts by weight of a dry-process fine silica powder (BET specific surface area: 200 $m^2/g$) with dimethyldichlorosilane and further with hexamethyldisilazane and with dimethylsilicone oil were added, and these were mixed by means of a Henschel mixer, followed by sieving with a filter having a mesh size of 150 μm to obtain toner 15.

Physical properties of the toner are shown together in Table 1.

With respect to the toner 15 thus obtained, the following evaluation tests were made. "Evaluation A" is evaluation made using an apparatus having a fixing unit of a halogen lamp type. "Evaluation B" is evaluation made using an apparatus having a fixing unit of an induction heating type.

Evaluation A

Image Evaluation Test

A commercially available laser beam printer LBP-950 (manufactured by CANON INC.; AC bias of Vpp=1,600 V and f=2,000 Hz applied; fixing by a halogen lamp method; process speed: 144 mm/sec) was used, and 1,000 g of the above toner (magnetic toner) 15 was put in its process cartridge. The process cartridge having this magnetic toner 15 put therein was mounted on the main body of the printer.

Copies of a test chart having a print percentage (image area percentage) of 6% were taken on 100,000 sheets in a normal temperature/normal humidity environment (N/N; 23° C./60%RH), and copies of a test chart having a print percentage (image area percentage) of 4% were taken on 20,000 sheets in each of a normal temperature/low humidity environment (N/L; 23° C./5%RH) and a high temperature/high humidity environment (H/H; 30° C./80%RH) to make image evaluation with respect to image density, fog, dot reproducibility, and stained images caused by faulty cleaning or toner melt adhesion.

The image density was measured with "Macbeth Reflection Densitometer" (manufactured by Macbeth Co.). With respect of to the fog, the reflection density of transfer paper and the reflection density of transfer paper after the copying of a solid white image were measured with "Reflection Densitometer" (manufactured by Tokyo Denshoku Gijutsu Center K.K.), and a difference between them was regarded as fog value.

The dot reproducibility was evaluated in the following way: A latent image of a block check pattern (checkered pattern) constituted of one dot, two dots, three dots and four dots was formed on the photosensitive member through a laser, and this image was used as a measuring sample. This sample was observed with a magnifier, and the dot reproducibility was judged by the number of dot(s) of an image where the block check pattern was clearly recognizable. It shows that the smaller this number is, the better the dot reproducibility is.

With respect to the stained images, evaluation was made by visual observation of images formed.

AA (excellent): No stained image appears at all.

A (good): Minute stains appear, but no problem in practical use.

B (passable): Spot-like and line-like stains appear, repeating appearance and disappearance.

C (failure): Stains appear, and do not disappear.

The results of image evaluation on these are shown together in Table 2.

Evaluation B

Image Evaluation Test

A commercially available laser beam printer LBP-950 was so remodeled that the AC bias values of the developing part were changed to Vpp=2,100 V and f=2,300 Hz, the fixing assembly part was changed to the electromagnetic induction heating fixing unit shown in FIG. 3 and the process speed was set at 200 mm/sec). Then, 1,000 g of the magnetic toner 15 was put in its process cartridge. The process cartridge having this magnetic toner 15 put therein was mounted on the main body of the printer.

Copies of a test chart having a print percentage (image area percentage) of 6% were taken on 100,000 sheets in a normal temperature/normal humidity environment (N/N; 23° C./60%RH), and copies of a test chart having a print percentage (image area percentage) of 4% were taken on 20,000 sheets in each of a normal temperature/low humidity environment (N/L; 23° C./5%RH) and a high temperature/high humidity environment (H/H; 30° C./80%RH) to make image evaluation with respect to image density, fog, dot reproducibility, and stained images caused by faulty cleaning or toner melt adhesion. Also, in this test machine, the heat generation layer of the rotary heating member was in a thickness of 3 mm, and the rotary pressure member was in contact with it at a nip width of 6.0 mm and a linear pressure of 50,000 N/m.

The image density was measured with "Macbeth Reflection Densitometer" (manufactured by Macbeth Co.). With respect to the fog, the reflection density of transfer paper and the reflection density of transfer paper after the copying of a solid white image were measured with "Reflection Densitometer" (manufactured by Tokyo Denshoku Gijutsu Center K.K.), and a difference between them was regarded as fog value.

The dot reproducibility was evaluated in the following way: A latent image of a block check pattern (checkered pattern) constituted of one dot, two dots, three dots and four dots was formed on the photosensitive member through a laser, and developed. Thereafter, the toner image formed was transferred to a transfer medium, which was then passed through an external fixing assembly set up as shown in FIG. 2, which was so remodeled as to have a process speed of 150 mm/sec. The fixed image thus obtained was used as a measuring sample. Here, the surface temperature of the upper, fixing roller was set at 190° C. This sample was observed with a magnifier, and the dot reproducibility was judged by the number of dot(s) of an image where the block check pattern was clearly recognizable. It shows that the smaller this number is, the better the dot reproducibility is.

With respect to the stained images, evaluation was made by visual observation of images formed.

AA (excellent): No stained image appears at all.

A (good): Minute stains appear, but no problem in practical use.

B (passable): Spot-like and line-like stains appear, repeating appearance and disappearance.

C (failure): Stains appear, and do not disappear.

Fixing Performance Test

The fixing unit as shown in FIG. 3 was remodeled into an external fixing assembly in such a way that it was operable also outside the copying machine, its fixing temperature was able to be arbitrarily set, the heat generation layer of the rotary heating member was in a thickness of 3 mm and the rotary pressure member was in contact with it at a nip width of 6.0 mm and a linear pressure of 50,000 N/m. Using this fixing assembly, unfixed toner images transferred onto sheets of paper of 80 g/m$^2$ basis weight were fixed to evaluate fixing performance. Temperature was controlled at intervals of 5° C. in the temperature range of from 140 to 190° C., and the unfixed toner images were fixed at each temperature. The images thus obtained were back and forth rubbed five times with Silbon paper under a load of 4.9 kPa. The point at which the rate of decrease in image density before and after the rubbing came to 10% was regarded as fixing start temperature. The lower this temperature is, the better the fixing performance is.

Anti-offset Properties Evaluation Test

The fixing unit as shown in FIG. 3 was remodeled into an external fixing assembly in such a way that it was operable also outside the copying machine, its fixing temperature was able to be arbitrarily set, the heat generation layer of the rotary heating member was in a thickness of 3 mm and the rotary pressure member was in contact with it at a nip width of 6.0 mm and a linear pressure of 50,000 N/m. Using this fixing assembly, unfixed toner images transferred onto sheets of paper of 50 g/m$^2$ basis weight were fixed to evaluate fixing performance. Temperature was controlled at intervals of 5° C. in the temperature range of from 190 to 240° C., and occurrence of offset was observed, measuring the temperature at which the offset occurred (evaluation environment: normal temperature/normal humidity environment of 23° C./60%RH). Also, as to the transfer paper, images were formed on its felt side (the side having smooth paper surface) to make the test.

The results of image and performance evaluation on these are shown together in Table 3.

TABLE 1

| | Example | | | | | Comparative Example | Example | |
|---|---|---|---|---|---|---|---|---|
| | 1 | 2 | 3 | 4 | 5 | 1 | 7 | 7 |
| Toner No: | 1 | 2 | 3 | 4 | 5 | 6 | 7 | 8 |
| Carboxyl-group-containing vinyl resin: | B-1 | B-2 | B-3 | B-4 | B-5 | B-6* | B-7 | B-1 |
| Epoxy-group-containing vinyl resin: | C-1 | C-2 | C-1 | C-1 | C-1 | C-1 | C-1 | C-1 |
| Resin mixing ratio B/C: | 90/10 | 90/10 | 90/10 | 95/5 | 95/5 | 90/10 | 90/10 | 90/10 |
| Magnetic material: | D-1 | D-1 | D-1 | D-1 | D-1 | D-1 | D-1 | D-2 |
| Liberated magnetic material/particles: | 100 | 300 | 270 | 300 | 180 | 300 | 680 | 150 |
| $\log_{10}$ (Max/Min) (toner): | 0.33 | 0.55 | 0.43 | 0.62 | 0.73 | 1.28 | 1.73 | 0.50 |
| Av (toner): | 8.2 | 0.3 | 4.0 | 30.8 | 45.2 | 0 | 51.5 | 8.2 |
| Mn (toner): | 4,800 | 4,500 | 4,500 | 4,800 | 4,600 | 6,800 | 4,800 | 5,000 |
| Mw (toner): | 76,000 | 95,000 | 78,000 | 92,000 | 98,000 | 700,000 | 110,000 | 76,000 |
| Peak molecular weight (toner): | 12,000 | 12,000 | 12,000 | 12,000 | 12,000 | 12,000 | 12,000 | 12,000 |
| Peak area of 30,000 or less: | 78 | 78 | 77 | 77 | 82 | 59 | 80 | 80 |
| THF-insoluble matter (toner): | 20 | 20 | 18 | 35 | 42 | 0 | 55 | 20 |

| | Example | | | Comparative Example | | Example | |
|---|---|---|---|---|---|---|---|
| | 8 | 9 | 10 | 2 | 3 | 11 | 12 |
| Toner No: | 9 | 10 | 11 | 12 | 13 | 14 | 15 |
| Carboxyl-group-containing vinyl resin: | B-1 | B-1 | B-1 | B-5 | B-8 | B-1 | B-1 |
| Epoxy-group-containing vinyl resin: | C-1 | C-1 | C-1 | C-2 | C-2 | C-1 | C-1 |
| Resin mixing ratio B/C: | 90/10 | 90/10 | 90/10 | 90/10 | 90/10 | 90/10 | 90/10 |
| Magnetic material: | D-3 | D-4 | D-5 | D-1 | D-1 | D-6 | D-7 |
| Liberated magnetic material/particles: | 160 | 180 | 150 | 700 | 750 | 510 | 120 |
| $\log_{10}$ (Max/Min) (toner): | 0.52 | 0.53 | 0.55 | 2.02 | 2.18 | 1.21 | 0.48 |
| Av (toner): | 8.2 | 8.2 | 8.2 | 40.1 | 0.8 | 8.2 | 8.2 |
| Mn (toner): | 4,700 | 4,800 | 4,800 | 4,200 | 6,000 | 4,800 | 4,800 |
| Mw (toner): | 76,000 | 76,000 | 76,000 | 150,000 | 2,000,000 | 76,000 | 76,000 |
| Peak molecular weight (toner): | 12,000 | 12,000 | 12,000 | 12,000 | 12,000 | 12,000 | 12,000 |
| Peak area of 30,000 or less: | 79 | 77 | 80 | 79 | 65 | 79 | 78 |
| THF-insoluble matter (toner): | 20 | 20 | 20 | 65 | 30 | 20 | 20 |

*Containing no carboxyl group

TABLE 2

| | Evaluation A | | | | | | | | | | | | | | |
|---|---|---|---|---|---|---|---|---|---|---|---|---|---|---|---|
| | Example | | | | | Cp | Example | | | | | Cp | | Example | |
| | 1 | 2 | 3 | 4 | 5 | 1 | 6 | 7 | 8 | 9 | 10 | 2 | 3 | 11 | 12 |
| Toner No.: | 1 | 2 | 3 | 4 | 5 | 6 | 7 | 8 | 9 | 10 | 11 | 12 | 13 | 14 | 15 |
| N/N | | | | | | | | | | | | | | | |
| Image density: | 1.43 | 1.43 | 1.42 | 1.42 | 1.41 | 1.28 | 1.12 | 1.43 | 1.42 | 1.42 | 1.42 | 1.08 | 1.21 | 1.26 | 1.40 |
| Fog: | 0.43 | 0.58 | 0.44 | 0.55 | 0.51 | 1.50 | 1.83 | 0.82 | 0.79 | 0.63 | 0.50 | 2.10 | 3.18 | 1.51 | 0.51 |

TABLE 2-continued

| | Evaluation A | | | | | | | | | | | | | | |
|---|---|---|---|---|---|---|---|---|---|---|---|---|---|---|---|
| | Example | | | | | Cp | Example | | | | | Cp | | Example | |
| | 1 | 2 | 3 | 4 | 5 | 1 | 6 | 7 | 8 | 9 | 10 | 2 | 3 | 11 | 12 |
| Dot reproducibility: | 1 | 1 | 1 | 1 | 1 | 2 | 2 | 1 | 1 | 1 | 1 | 3 | 3 | 3 | 1 |
| Stained images: | AA | AA | AA | AA | AA | B | A | AA | AA | AA | AA | B | B | B | AA |
| N/L | | | | | | | | | | | | | | | |
| Image density: | 1.43 | 1.44 | 1.44 | 1.42 | 1.40 | 1.30 | 1.21 | 1.43 | 1.43 | 1.43 | 1.42 | 1.11 | 1.23 | 1.28 | 1.41 |
| Fog: | 0.58 | 0.61 | 0.55 | 0.63 | 0.60 | 1.28 | 2.43 | 0.98 | 0.89 | 0.71 | 0.61 | 3.18 | 3.55 | 1.70 | 0.68 |
| Dot reproducibility: | 1 | 2 | 1 | 2 | 1 | 3 | 3 | 1 | 1 | 1 | 1 | 4 | 4 | 4 | 1 |
| Stained images: | AA | A | AA | A | AA | C | B | AA | AA | AA | AA | C | C | B | AA |
| H/H | | | | | | | | | | | | | | | |
| Image density: | 1.41 | 1.40 | 1.39 | 1.28 | 1.30 | 1.25 | 1.01 | 1.40 | 1.38 | 1.39 | 1.39 | 0.98 | 1.11 | 1.02 | 1.39 |
| Fog: | 0.38 | 0.32 | 0.33 | 0.40 | 0.30 | 1.08 | 1.51 | 0.71 | 0.68 | 0.51 | 0.39 | 2.02 | 2.80 | 1.31 | 0.78 |
| Dot reproducibility: | 1 | 1 | 1 | 1 | 1 | 2 | 2 | 1 | 1 | 1 | 1 | 3 | 3 | 2 | 1 |
| Stained images: | AA | AA | AA | AA | AA | B | A | AA | AA | AA | AA | B | B | A | AA |

Cp: Comparative Example

TABLE 3

| | Evaluation B | | | | | | | | | | | | | | |
|---|---|---|---|---|---|---|---|---|---|---|---|---|---|---|---|
| | Example | | | | | Cp | Example | | | | | Cp | | Example | |
| | 1 | 2 | 3 | 4 | 5 | 1 | 6 | 7 | 8 | 9 | 10 | 2 | 3 | 11 | 12 |
| Toner No.: | 1 | 2 | 3 | 4 | 5 | 6 | 7 | 8 | 9 | 10 | 11 | 12 | 13 | 14 | 15 |
| Fixing performance: | 150 | 155 | 155 | 150 | 150 | 160 | 170 | 150 | 150 | 150 | 150 | 160 | 165 | 150 | 130 |
| Anti-offset properties: | >240 | 240 | >240 | >240 | >240 | 205 | >240 | >240 | >240 | >240 | >240 | >240 | >240 | >240 | 240 |
| Toner No.: | 1 | 2 | 3 | 4 | 5 | 6 | 7 | 8 | 9 | 10 | 11 | 12 | 13 | 14 | 15 |
| N/N | | | | | | | | | | | | | | | |
| Image density: | 1.41 | 1.41 | 1.42 | 1.36 | 1.36 | 1.25 | 0.90 | 1.41 | 1.41 | 1.41 | 1.41 | 1.03 | 0.98 | 1.25 | 1.40 |
| Fog: | 0.58 | 0.82 | 0.64 | 0.95 | 0.63 | 1.61 | 1.85 | 0.85 | 0.80 | 0.71 | 0.70 | 2.58 | 4.81 | 1.32 | 0.55 |
| Dot reproducibility: | 1 | 2 | 1 | 2 | 1 | 3 | 3 | 1 | 1 | 1 | 1 | 3 | 4 | 2 | 1 |
| Stained images: | AA | AA | AA | AA | AA | B | A | AA | AA | AA | AA | B | C | B | AA |
| N/L | | | | | | | | | | | | | | | |
| Image density: | 1.44 | 1.43 | 1.44 | 1.39 | 1.38 | 1.20 | 1.18 | 1.42 | 1.43 | 1.41 | 1.42 | 1.08 | 1.08 | 1.25 | 1.40 |
| Fog: | 0.80 | 0.92 | 0.75 | 0.82 | 0.53 | 1.78 | 2.66 | 0.72 | 0.74 | 0.75 | 0.65 | 3.76 | 3.81 | 1.68 | 0.51 |
| Dot reproducibility: | 1 | 2 | 1 | 2 | 1 | 4 | 4 | 1 | 1 | 1 | 1 | 4 | 4 | 3 | 1 |
| Stained images: | AA | A | AA | A | AA | C | B | AA | AA | AA | AA | C | C | B | AA |
| H/H | | | | | | | | | | | | | | | |
| Image density: | 1.36 | 1.39 | 1.38 | 1.19 | 1.22 | 1.21 | 1.00 | 1.33 | 1.37 | 1.36 | 1.33 | 0.99 | 0.88 | 1.08 | 1.40 |
| Fog: | 0.57 | 0.82 | 0.68 | 0.94 | 0.67 | 1.01 | 1.62 | 0.68 | 0.47 | 0.55 | 0.63 | 2.81 | 4.21 | 1.06 | 0.68 |
| Dot reproducibility: | 1 | 1 | 1 | 1 | 1 | 2 | 3 | 1 | 1 | 1 | 1 | 3 | 3 | 2 | 1 |
| Stained images: | AA | AA | AA | AA | AA | B | A | AA | AA | AA | AA | A | B | A | AA |

Cp: Comparative Example

What is claimed is:

1. A toner comprising a binder resin and a colorant, wherein;

said toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and said toner has, in its dielectric dissipation factor (tan δ), at least a maximum value and a minimum value in the temperature range of from 20° C. to 150° C., and, where the maximum value is represented by Max and the minimum value by Min, has a value of $\log_{10}(Max/Min) \leqq 2$.

2. The toner according to claim 1, which has, in molecular weight distribution measured by gel permeation chromatography of tetrahydrofuran-soluble matter in the toner, a number-average molecular weight of from 1,000 to 40,000 and a weight-average molecular weight of from 10,000 to 10,000,000.

3. The toner according to claim 1, which has, in molecular weight distribution measured by gel permeation chromatography of tetrahydrofuran-soluble matter in the toner, at least one main peak in the region of molecular weight of from 4,000 to 30,000.

4. The toner according to claim 3, wherein, in said molecular weight distribution, the peak area in the region of molecular weight of 30,000 or lower is in a proportion of from 60% to 100% with respect to the total peak area.

5. The toner according to claim 1, wherein said binder resin contains a tetrahydrofuran-insoluble matter in an amount of from 0.1% by weight to 60% by weight.

6. The toner according to claim 1, which has a THF-soluble matter having an acid value of from 0.1 mg·KOH/g to 50 mg·KOH/g.

7. The toner according to claim 1, wherein said colorant is a magnetic material.

8. The toner according to claim 7, wherein said magnetic material is a magnetic iron oxide containing at least one element A belonging to the third and following periods of the long form of the periodic table and having an electronegativity of from 1.0 to 2.5;

said element A being contained in said magnetic material in a content of from 0.1% by weight to 4.0% by weight on the basis of Fe in said magnetic material; and said magnetic material standing liberated into the toner in a number of from 70 particles to 500 particles per 10,000 toner particles.

9. The toner according to claim 8, wherein said element A is an element selected from the group consisting of Al, Si, P, Ti, V, Cr, Mn, Co, Ni, Cu, Zn, Ga, Ge, Zr, Sn and Pb.

10. The toner according to claim 8, wherein said element A is an element selected from the group consisting of Al, Si, Ti, Mn and Zn.

11. The toner according to claim 7, wherein said magnetic material is contained in an amount of from 10 parts by weight to 200 parts by weight based on 100 parts by weight of the binder resin.

12. An image-forming apparatus comprising a developing means for moving a toner to an electrostatic latent image formed on a photosensitive member, to render the electrostatic latent image visible to form a toner image, and a transfer means for transferring the toner image to a transfer medium to form an image;

in a developer-carrying member of said developing means, at least an alternating-current bias being applied to make the toner adhere to the electrostatic latent image to form a visible image; and said toner comprising a binder resin and a colorant;

wherein;

said toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and said toner has, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$.

13. The image-forming apparatus according to claim 12, wherein said toner has, in molecular weight distribution measured by gel permeation chromatography of tetrahydrofuran-soluble matter in the toner, a number-average molecular weight of from 1,000 to 40,000 and a weight-average molecular weight of from 10,000 to 10,000,000.

14. The image-forming apparatus according to claim 12, wherein said toner has, in molecular weight distribution measured by gel permeation chromatography of tetrahydrofuran-soluble matter in the toner, at least one main peak in the region of molecular weight of from 4,000 to 30,000.

15. The image-forming apparatus according to claim 14, wherein, in said molecular weight distribution, the peak area in the region of molecular weight of 30,000 or lower is in a proportion of from 60% to 100% with respect to the total peak area.

16. The image-forming apparatus according to claim 12, wherein said binder resin of said toner contains a tetrahydrofuran-insoluble matter in an amount of from 0.1% by weight to 60% by weight.

17. The image-forming apparatus according to claim 12, wherein said toner has a THF-soluble matter having an acid value of from 0.1 mg·KOH/g to 50 mg·KOH/g.

18. The image-forming apparatus according to claim 12, wherein said colorant is a magnetic material.

19. The image-forming apparatus according to claim 18, wherein said magnetic material is a magnetic iron oxide containing at least one element A belonging to the third and following periods of the long form of the periodic table and having an electronegativity of from 1.0 to 2.5;

said element A being contained in said magnetic material in a content of from 0.1% by weight to 4.0% by weight on the basis of Fe in said magnetic material; and said magnetic material standing liberated into the toner in a number of from 70 particles to 500 particles per 10,000 toner particles.

20. The image-forming apparatus according to claim 19, wherein said element A is an element selected from the group consisting of Al, Si, P, Ti, V, Cr, Mn, Co, Ni, Cu, Zn, Ga, Ge, Zr, Sn and Pb.

21. The image-forming apparatus according to claim 19, wherein said element A is an element selected from the group consisting of Al, Si, Ti, Mn and Zn.

22. The image-forming apparatus according to claim 18, wherein said magnetic material is contained in an amount of from 10 parts by weight to 200 parts by weight based on 100 parts by weight of the binder resin.

23. A process cartridge comprising:

an electrostatic image-bearing member, and developing means for developing an electrostatic image formed on the electrostatic image-bearing member with a toner contained therein; the electrostatic image-bearing member and the developing means being integrally assembled to form a process cartridge, which is detachably mountable to a main assembly of the image forming apparatus; and said toner comprising a binder resin and a colorant;

wherein;

said toner contains as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and said toner has, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$.

24. The process cartridge according to claim 23, wherein said toner has, in molecular weight distribution measured by gel permeation chromatography of tetrahydrofuran-soluble matter in the toner, a number-average molecular weight of from 1,000 to 40,000 and a weight-average molecular weight of from 10,000 to 10,000,000.

25. The process cartridge according to claim 23, wherein said toner has, in molecular weight distribution measured by gel permeation chromatography of tetrahydrofuran-soluble matter in the toner, at least one main peak in the region of molecular weight of from 4,000 to 30,000.

26. The process cartridge according to claim 25, wherein, in said molecular weight distribution, the peak area in the region of molecular weight of 30,000 or lower is in a proportion of from 60% to 100% with respect to the total peak area.

27. The process cartridge according to claim 23, wherein said binder resin of said toner contains a tetrahydrofuran-insoluble matter in an amount of from 0.1% by weight to 60% by weight.

28. The process cartridge according to claim 23, wherein said toner has a THF-soluble matter having an acid value of from 0.1 mg·KOH/g to 50 mg·KOH/g.

29. The process cartridge according to claim 23, wherein said colorant is a magnetic material.

30. The process cartridge according to claim 29, wherein said magnetic material is a magnetic iron oxide containing at least one element A belonging to the third and following periods of the long form of the periodic table and having an electronegativity of from 1.0 to 2.5;

said element A being contained in said magnetic material in a content of from 0.1% by weight to 4.0% by weight on the basis of Fe in said magnetic material; and said magnetic material standing liberated into the toner in a number of from 70 particles to 500 particles per 10,000 toner particles.

31. The process cartridge according to claim 30, wherein said element A is an element selected from the group consisting of Al, Si, P, Ti, V, Cr, Mn, Co, Ni, Cu, Zn, Ga, Ge, Zr, Sn and Pb.

32. The process cartridge according to claim 30, wherein said element A is an element selected from the group consisting of Al, Si, Ti, Mn and Zn.

33. The process cartridge according to claim 29, wherein said magnetic material is contained in an amount of from 10 parts by weight to 200 parts by weight based on 100 parts by weight of the binder resin.

34. An image-forming method comprising subjecting a toner image held on a transfer medium, to heat-and-pressure fixing by a heat-and-pressure fixing means to form a fixed image on the transfer medium, wherein;

(1) a toner which forms the toner image is a toner comprising a binder resin and a colorant;

said toner containing as the binder resin at least a vinyl resin selected from the group consisting of:

a vinyl resin having a carboxyl group and a vinyl resin having an epoxy group;

a vinyl resin having a carboxyl group and an epoxy group; and a vinyl resin produced by the reaction of a carboxyl group with an epoxy group; and said toner having, in its dielectric dissipation factor (tan δ), at least a maximum value and a minimum value in the temperature range of from 20° C. to 150° C., and, where the maximum value is represented by Max and the minimum value by Min, having a value of $\log_{10}(Max/Min) \leqq 2$; and (2) as said heat-and-pressure fixing means, a heat-and-pressure fixing means is used which has at least;

(i) a magnetic field generation means;

(ii) a rotary heating member having at least a heat generation layer capable of generating heat by electromagnetic induction, and a release layer; and (iii) a rotary pressure member which forms a nip with the heating member; and said toner image held on said transfer medium is heat and pressure fixed while said rotary pressing member is pressed against said rotary heating member via said transfer medium.

35. The image-forming method according to claim 34, wherein said toner has, in molecular weight distribution measured by gel permeation chromatography of tetrahydrofuran-soluble matter in the toner, a number-average molecular weight of from 1,000 to 40,000 and a weight-average molecular weight of from 10,000 to 10,000,000.

36. The image-forming method according to claim 34, wherein said toner has, in molecular weight distribution measured by gel permeation chromatography of tetrahydrofuran-soluble matter in the toner, at least one main peak in the region of molecular weight of from 4,000 to 30,000.

37. The image-forming method according to claim 36, wherein, in said molecular weight distribution, the peak area in the region of molecular weight of 30,000 or lower is in a proportion of from 60% to 100% with respect to the total peak area.

38. The image-forming method according to claim 34, wherein said binder resin of said toner contains a tetrahydrofuran-insoluble matter in an amount of from 0.1% by weight to 60% by weight.

39. The image-forming method according to claim 34, wherein said toner has a THF-soluble matter having an acid value of from 0.1 mg·KOH/g to 50 mg·KOH/g.

40. The image-forming method according to claim 34, wherein said colorant is a magnetic material.

41. The image-forming method according to claim 40, wherein said magnetic material is a magnetic iron oxide containing at least one element A belonging to the third and following periods of the long form of the periodic table and having an electronegativity of from 1.0 to 2.5;

said element A being contained in said magnetic material in a content of from 0.1% by weight to 4.0% by weight on the basis of Fe in said magnetic material; and said magnetic material standing liberated into the toner in a number of from 70 particles to 500 particles per 10,000 toner particles.

42. The image-forming method according to claim 41, wherein said element A is an element selected from the group consisting of Al, Si, P, Ti, V, Cr, Mn, Co, Ni, Cu, Zn, Ga, Ge, Zr, Sn and Pb.

43. The image-forming method according to claim 41, wherein said element A is an element selected from the group consisting of Al, Si, Ti, Mn and Zn.

44. The image-forming method according to claim 40, wherein said magnetic material is contained in an amount of from 10 parts by weight to 200 parts by weight based on 100 parts by weight of the binder resin.

* * * * *

UNITED STATES PATENT AND TRADEMARK OFFICE

CERTIFICATE OF CORRECTION

PATENT NO. : 6,670,087 B2
DATED : December 30, 2003
INVENTOR(S) : Hiroyuki Fujikawa et al.

It is certified that error appears in the above-identified patent and that said Letters Patent is hereby corrected as shown below:

Column 17,
Line 4, "pulyerix" should read -- pulveriz --.

Column 28,
Line 30, "styrene, parts" should read -- styrene, 20 parts --; and
Line 31, "of 20" should read -- of --.

Column 30,
Line 31, "In to" should read -- Into --.

Column 37,
Line 46, "of" (first occurrence) should read -- to --.

Column 40,

Table 1, "Example 7 7" should read -- Example 6 7 --.

Signed and Sealed this

Twenty-fourth Day of August, 2004

JON W. DUDAS
*Director of the United States Patent and Trademark Office*